US008616489B2

(12) United States Patent
Goeking et al.

(10) Patent No.: US 8,616,489 B2
(45) Date of Patent: Dec. 31, 2013

(54) SHEET PRODUCT DISPENSER

(75) Inventors: Harold J. Goeking, Oshkosh, WI (US); Robert W. Cornell, Rothschild, WI (US); Panagiotis Zosimadis, Brampton (CA); Noah McNeely, Suwanee, GA (US)

(73) Assignee: Georgia-Pacific Consumer Products LP, Atlanta, GA (US)

( * ) Notice: Subject to any disclaimer, the term of this patent is extended or adjusted under 35 U.S.C. 154(b) by 981 days.

(21) Appl. No.: 12/437,974

(22) Filed: May 8, 2009

(65) Prior Publication Data

US 2010/0286817 A1 Nov. 11, 2010

(51) Int. Cl.
*B65H 20/02* (2006.01)

(52) U.S. Cl.
USPC ..... 242/564.4; 242/563.1; 242/565

(58) Field of Classification Search
USPC ..... 242/564, 564.1, 564.3, 564.4, 565, 560, 242/560.1, 563, 563.1, 563.2
See application file for complete search history.

(56) References Cited

U.S. PATENT DOCUMENTS

| | | | | |
|---|---|---|---|---|
| 3,133,466 | A | 5/1964 | Seifert | |
| 3,628,743 | A | 12/1971 | Bastian et al. | |
| 3,866,056 | A | 2/1975 | Minniear et al. | |
| 4,067,509 | A | 1/1978 | Graham, Jr. et al. | |
| 4,165,138 | A | 8/1979 | Hedge et al. | |
| 4,260,117 | A | 4/1981 | Perrin et al. | |
| 4,378,912 | A | 4/1983 | Perrin et al. | |
| 5,294,192 | A | 3/1994 | Omdoll et al. | |
| 5,526,973 | A | 6/1996 | Boone et al. | |
| 5,558,302 | A | 9/1996 | Jesperson | |
| 5,758,982 | A | 6/1998 | Yoshida et al. | |
| 5,934,167 | A | 8/1999 | Yamamoto | |
| 6,079,305 | A * | 6/2000 | Bloch et al. | 83/335 |
| 6,334,587 | B1 | 1/2002 | Roder | |
| 6,354,533 | B1 | 3/2002 | Jespersen | |
| 6,370,844 | B1 | 4/2002 | Stricker | |
| 6,412,726 | B2 | 7/2002 | Inana et al. | |
| 6,419,136 | B2 | 7/2002 | Formon et al. | |

(Continued)

FOREIGN PATENT DOCUMENTS

| | | | |
|---|---|---|---|
| DE | 10115200 | A1 | 10/2002 |
| EP | 1297770 | A1 | 4/2003 |

(Continued)

OTHER PUBLICATIONS

International Search Report and Written Opinion of the International Search Authority for PCT/US2010/033829 dated Jan. 18, 2011.

(Continued)

*Primary Examiner* — William A Rivera
(74) *Attorney, Agent, or Firm* — Sutherland Asbill & Brennan LLP

(57) ABSTRACT

A sheet product dispenser is provided for sheet product from a roller. The sheet product dispenser includes a first roll of sheet product, called a stub roll, a main roll of sheet product, and a dispensing arrangement. A sensor is provided for detecting when sheet product on a stub roll is depleted. The sensor generates a signal in response to the depletion of the stub roll and a controller activates an electromechanical actuator. The actuator acts to operate a transfer bar that moves an end portion of the main roll sheet product adjacent a roller assembly that engages the main roller sheet product.

10 Claims, 24 Drawing Sheets

(56) References Cited

U.S. PATENT DOCUMENTS

| | | | | |
|---|---|---|---|---|
| 6,592,067 | B2 | 7/2003 | Denen et al. | |
| 6,736,348 | B1 * | 5/2004 | Formon et al. | 242/560.1 |
| 6,820,785 | B2 | 11/2004 | Kapiloff | |
| 6,826,985 | B2 | 12/2004 | Broehl | |
| 6,826,991 | B1 | 12/2004 | Rasmussen | |
| 6,854,684 | B2 | 2/2005 | Byrd et al. | |
| 6,892,620 | B2 | 5/2005 | Kapiloff | |
| 6,903,654 | B2 | 6/2005 | Hansen et al. | |
| 6,962,451 | B2 | 11/2005 | Narita et al. | |
| 6,977,588 | B2 | 12/2005 | Schotz et al. | |
| 7,044,421 | B1 | 5/2006 | Omdoll et al. | |
| 7,237,744 | B2 | 7/2007 | Morris et al. | |
| 7,270,292 | B2 | 9/2007 | Rasmussen | |
| 2002/0109036 | A1 | 8/2002 | Denen et al. | |
| 2002/0117578 | A1 | 8/2002 | Denen et al. | |
| 2003/0116003 | A1 | 6/2003 | Kapiloff | |
| 2003/0168489 | A1 | 9/2003 | Formon et al. | |
| 2003/0177850 | A1 | 9/2003 | Whittington | |
| 2004/0099678 | A1 | 5/2004 | Windorski et al. | |
| 2005/0145745 | A1 | 7/2005 | Lewis et al. | |
| 2005/0167541 | A1 | 8/2005 | Osborne | |
| 2005/0171634 | A1 | 8/2005 | York et al. | |
| 2005/0220462 | A1 | 10/2005 | Miyaji | |
| 2006/0169827 | A1 * | 8/2006 | Lewis et al. | 242/563 |
| 2006/0173576 | A1 | 8/2006 | Goerg et al. | |
| 2007/0246580 | A1 | 10/2007 | Matlin et al. | |
| 2008/0078777 | A1 | 4/2008 | Cittadino et al. | |
| 2008/0099595 | A1 * | 5/2008 | Lewis et al. | 242/560 |
| 2009/0198373 | A1 | 8/2009 | Mok et al. | |
| 2010/0286818 | A1 | 11/2010 | Goeking et al. | |
| 2011/0253829 | A1 | 10/2011 | Goeking et al. | |

FOREIGN PATENT DOCUMENTS

| | | | |
|---|---|---|---|
| EP | 1405590 | A1 | 6/2003 |
| WO | 03/051166 | A1 | 4/2004 |
| WO | 2007/039790 | A1 | 4/2007 |
| WO | 2009/055473 | A1 | 4/2009 |

OTHER PUBLICATIONS

International Search Report and Written Opinion of the International Search Authority for PCT/US2010/033828 dated Jan. 18, 2011.
Office Action mailed Nov. 19, 2012 for U.S. Appl. No. 12/437,921.

* cited by examiner

SHEET PRODUCT DISPENSER

BACKGROUND OF THE INVENTION

The present invention relates generally to a sheet product dispenser, and in particular to a sheet product dispenser that provides for the detecting of sheet product and for the loading of sheet product for dispensing.

Sheet product dispensers typically include multiple rolls of sheet product. The sheet product dispensers are typically arranged to allow maintenance personnel to utilize a partially depleted roll sometimes referred to as a "stub roll." This partially depleted or stub roll is usually placed in a position to dispense sheet product first to maximize the utilization of sheet product and minimize waste. A second roll, usually a full roll, is also placed within the sheet product dispenser to be used once the stub roll has been depleted.

While some sheet product dispensers merely store the full roll for later manual refilling by maintenance personnel, it generally preferred to have the secondary roll automatically dispense once the stub roll is depleted. The automatic dispensing of the secondary roll allows the operator of the dispenser is located to increase the time period between maintenance personnel visits, thus decreasing operating costs and minimizing waste. Sheet product is generally dispensed using a roller system where the sheet product is passed between two rollers and the resulting friction pulls the sheet product from the dispensing roll.

The switch from the stub roll to the secondary roll may be accomplished using a bar that pushes the end of the secondary roll of sheet product into the rollers. Once the sheet product of the secondary roll has been positioned against the rollers, the resulting friction pulls the sheet product through the rollers and is thereafter dispensed to the user. It is desirable to minimize waste in the operation of the sheet product dispenser to minimize costs. However, it is also desirable to have sheet product available when the user activates the sheet product dispenser. These requirements have led to a variety of sheet dispensing mechanisms that try to balance these somewhat conflicting demands.

One category of sensing mechanisms used some type of mechanical lever that rested against the outer diameter of the stub roll to measure the amount of remaining sheet product. At a certain point, the diameter of the stub roll was small enough such that the lever activated the transfer mechanism allowing the sheet product from the secondary roll to be dispensed. While these mechanical systems worked well, due to the imprecise nature of detecting the diameter of the stub roll using a mechanical lever, the system inevitably needed to be set to have the secondary roll dispense prior to complete depletion of the stub roll. When this occurred, sheet product from both sheets was dispensed when the sheet product dispenser was activated. While this arrangement ensured that the user received sheet product, it also resulted in wasted sheet product and increased costs.

A second category of sensing mechanisms utilized a sensor positioned within a dispensing chute of the sheet product dispenser. The dispensing chute is an area adjacent an opening in the sheet product dispenser where the sheet product exits and is retrieved by the user. The sensor was coupled to a microprocessor that controls the operation of the sheet product dispenser. These sensors are arranged to detect the front edge of the sheet product or its absence. The microprocessor used edge detection to ensure that perforations in the sheet product were appropriately positioned at the end of a dispense cycle to allow the sheet product to be torn by an end user.

This second category of sheet product dispensers also typically had two motors. A drive motor operates the rollers to dispense sheet product as discussed above, and a transfer motor that activates a transfer bar to transfer sheet product from the secondary roll. The transfer motor is coupled to the transfer bar via a series of linkages that translate the rotational movement of the motor into a linear translation of the transfer bar. While this arrangement allowed for the automatic dispensing of sheet product from the second roll, several issues resulted. First, the use of the sensor in the chute limited the usage to sheet product having perforations since the tearing movement (through use of a tear bar for example) required for non-perforated sheet product could cause false signals to be generated by the sensor. Second, since the sensor detected the front edge of the sheet product, a short period of time would elapse before the rear edge of sheet product from the stub roll would pass the sensor and trigger the transfer mechanism. Thus there could be a considerable gap in the dispensing of sheet product while the sheet product dispenser triggered the transfer motor and transfer bar While existing sheet product dispensers are suitable for their intended purposes, there still remains a need for improvements particularly regarding the detecting when the sheet product on a stub roll has been depleted. There is also a need for improvements that minimize waste while providing consistent dispensing of sheet product for an end user. There is also a need to better detect a users presence while conserving battery power. Further, there is a need to minimize noise generated by the sheet product dispenser.

SUMMARY OF THE INVENTION

In accordance with one embodiment, a sheet product dispenser is provided. The sheet product dispenser includes a transfer bar movable between a first position and a second position. A roller assembly is positioned adjacent the transfer bar second position, the roller assembly having a feed roller and a pinch roller. An electromechanical actuator is arranged having a movable portion coupled to the transfer bar, wherein the movable portion is arranged to move the transfer bar between the first position and the second position. A sensor is arranged in operable communication with the roller assembly, the sensor being electrically coupled to the electromechanical actuator, wherein the movable portion moves the transfer bar from the first position to the second position in response to a signal from the sensor.

In accordance with another embodiment, a method of a dispensing sheet product is provided. The method includes the step of sensing the presence of a first sheet product adjacent a feed roller. A signal is generated if the first sheet product is not sensed. An electromechanical actuator is activated in response to the signal. A second sheet product first end is moved from a first position to a second position when the electromechanical actuator is activated.

In accordance with another embodiment, a dispenser having sheet product is provided. The dispenser includes a roller assembly having a shaft. The roller assembly is arranged to rotate in a first direction to dispense the sheet product in response to a first signal. A cam is coupled to one end of the shaft, the cam having a lobe comprising a first surface and a second surface. A switch having an actuator arm is positioned adjacent the cam. The actuator arm contacting the first surface when the roller assembly rotates in the first direction. Wherein the second surface is angled such that the actuator slides from the second surface to the first surface when the roller assembly is rotated in a second direction.

In accordance with another embodiment, a sheet product dispenser is provided. The sheet product dispenser including an electromechanical actuator. A cam is operably coupled to the electromechanical actuator to rotate from a first position to a second position, the cam having a surface thereon. A cam arm is slidably arranged adjacent the cam. The cam arm having a first portion in contact with the surface, wherein the cam arm moves from a third position to a fourth position when the cam moves from the first position to the second position. A transfer arm is coupled to the cam arm, the transfer arm movable between a fifth position and sixth position in response to the cam arm moving from the third position to the fourth position.

In accordance with another embodiment, a dispenser for sheet product is provided. The dispenser includes a frame and a roller assembly coupled to the frame. The roller assembly is arranged to rotate in a first direction to dispense the sheet product. A motor is arranged having a shaft. An isolator member is coupled between the motor and the frame. A belt is coupled between the roller assembly and the shaft.

In accordance with another embodiment, a method of operating a sheet product dispenser is provided. The method includes the step of determining when a cover has been closed. A sheet product is determined unavailable for dispensing after the cover is closed. A transfer bar is activated when it is determined sheet product is not available for dispensing. A drive motor is activated and sheet product is positioned for dispensing.

In accordance with another embodiment, a sheet product dispenser is provided. The sheet product dispenser includes a front cover. An optical emitter is positioned adjacent the front cover and on a first angle relative to the front cover. The optical emitter emits a light signal in a first cone shape. An optical receiver is positioned a first distance from the optical emitter and on a second angle relative to the front cover. The optical emitter is configured to receive light signals from an area being generally a second cone shape. Wherein the first angle and the second angle are arranged to overlap the first cone shape and the second cone shape.

BRIEF DESCRIPTION OF THE DRAWINGS

Referring now to the drawings, which are meant to be exemplary and not limiting, and wherein like elements are numbered alike.

DETAILED DESCRIPTION

Figure 1:
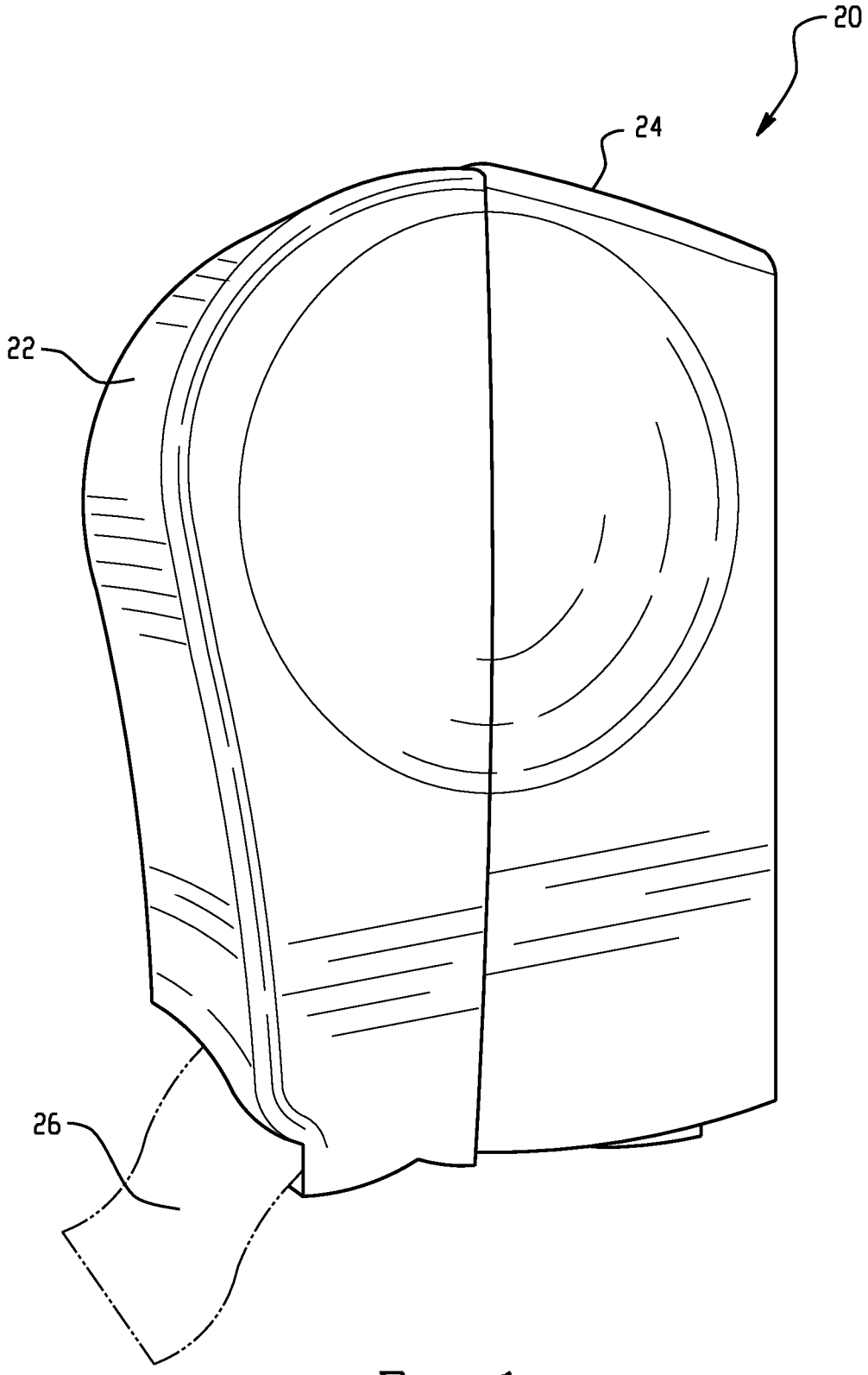
FIG. 1 is a perspective view illustration of a sheet product dispenser in accordance with the exemplary embodiment.
Figure 2:
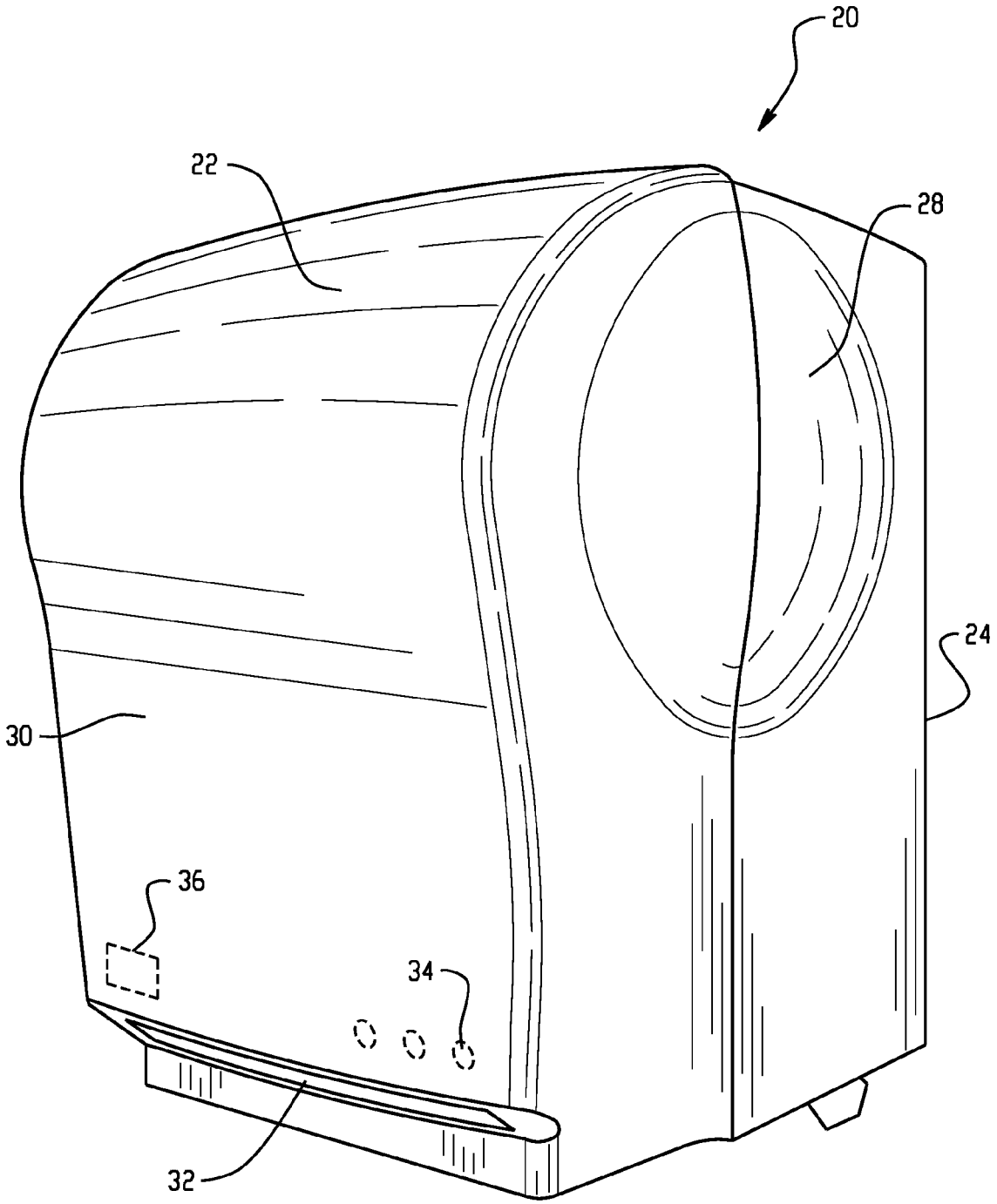
FIG. 2 is a perspective view illustration of the sheet product dispenser of FIG. 1.
Figure 3:
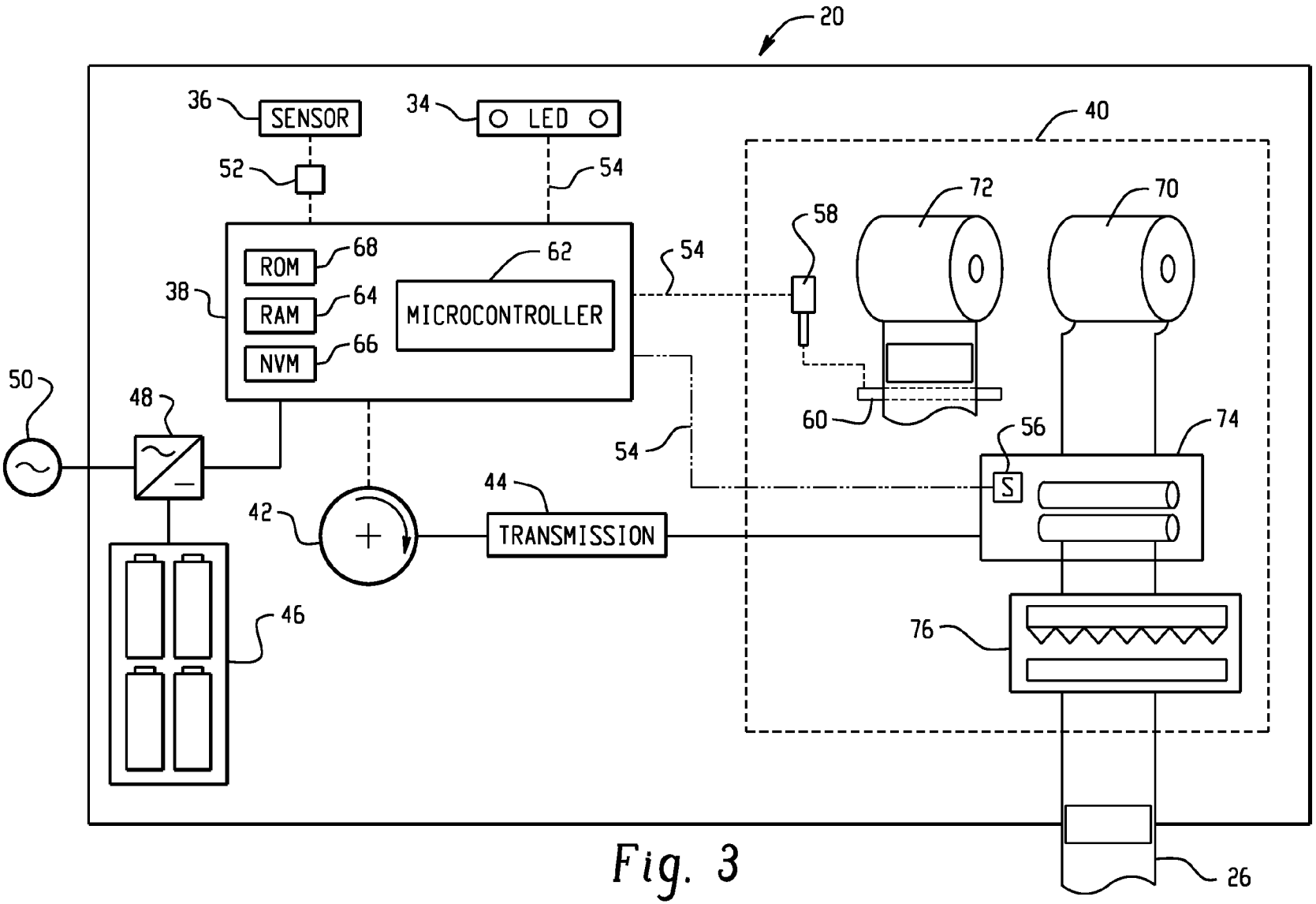
FIG. 3 is a schematic view illustration of the sheet product dispenser of FIG. 1.

FIG. 1-FIG. 3 illustrate an exemplary embodiment of a sheet product dispenser 20. The sheet product dispenser 20 includes a front cover 22 and a back plate 24 that is arranged to hold and dispense a sheet product 26. The term "sheet products" as used herein is inclusive of natural and/or synthetic cloth or paper sheets. Sheet products may include both woven and non-woven articles. There are a wide variety of nonwoven processes and they can be either wetlaid or drylaid. Some examples include hydroentagled (sometimes called spunlace), DRC (double re-creped), airlaid, spunbond, carded, paper towel, and meltblown sheet products. Further, sheet products may contain fibrous cellulosic materials that may be derived from natural sources, such as wood pulp fibers, as well as other fibrous material characterized by having hydroxyl groups attached to the polymer backbone. These include glass fibers and synthetic fibers modified with hydroxyl groups. Examples of sheet products include, but are not limited to, wipers, napkins, tissues, rolls, towels or other fibrous, film, polymer, or filamentary products.

In general sheet products are thin in comparison to their length and breadth and exhibit a relatively flat planar configuration and are flexible to permit folding, rolling, stacking, and the like. The sheet product 26 may have perforations extending in lines across its width to separate individual sheets and facilitate separation or tearing of individual sheets from the roll at discrete intervals. Individual sheets may be sized as desired to accommodate the many uses of the sheet products. For example, perforation lines may be formed every 13 inches to define a universally sized sheet. Multiple perforation lines may be provided to allow the user to select the size of sheet depending on the particular need.

The sheet product dispenser 20 may include an enlarged portion 28 that provides room in the interior of the sheet product dispenser 20 for a full roll of sheet product 26. The front cover 22 may be formed from any suitable material, such as a plastic, that is cost effective and meets the environmental requirements of the application. In the exemplary embodiment, the front cover 22 may be opaque, translucent or tinted. If the front cover 22 is translucent, it may provide advantages in allowing maintenance personnel to quickly determine the quantity of sheet product 26 remaining in the sheet product dispenser 20. In one embodiment, the sheet product dispenser 20 is water proof or water resistant, which allows the sheet product dispenser to be used in wet environments, such as a food processing facility for example.

The general shape of the sheet product dispenser 20 is arranged to minimize the size of the sheet product dispenser 20, the front cover 22 includes a tapered portion 30. The tapered portion 30 is located adjacent the dispensing slot 32. This tapering reduces the interior volume of the lower portion of the sheet product dispenser 20. The sheet product dispenser may include one or more light-emitting-diodes (LEDs) 34 to provide a visual indication as to the status of the sheet product dispenser. A proximity sensor 36 is also positioned adjacent the front cover 22 near the dispensing slot 32. The proximity sensor 36 may be any suitable sensor, such as an infrared sensor for example, that is capable of sensing the presence of a user's hand in front of the sheet product dispenser 20.

A schematic representation of the major components of the sheet product dispenser 20 is shown in FIG. 3. It should be appreciated that the illustration in FIG. 3 is for purposes of description and that the relative size and placement of the respective components may differ. The sheet product dispenser 20 includes a main controller 38. As will be described in more detail herein, the main controller 38 provides logic and control functionality used during operation of the sheet product dispenser 20. Alternatively, the functionality of the main controller 38 may be distributed to several controllers that each provides more limited functionality to discrete portions of the operation of sheet product dispenser 20. The main controller 38 is coupled to a dispensing mechanism 40 to dispense a sheet product 26 when activated by a user. A motor 42 and an optional transmission assembly 44 drive the dispensing mechanism 40. The optional transmission assembly 44, such as a gearbox for example, adapts the rotational output of the motor 42 for the dispensing of the sheet product 26.

In the exemplary embodiment, the electrical energy for operating the sheet product dispenser 20 is provided by a battery 46, which may be comprised of one or more batteries arranged in series or in parallel to provide the desired energy. To minimize maintenance costs, the amount of stored energy should allow the dispensing of at least 48,000 feet of sheet product. In the exemplary embodiment, the battery 46 includes four 1.5-volt "D" cell batteries. The battery 46 is connected to the main controller 38 via an optional power converter 48 that adapts the electrical output of the battery 46 to that desired for operating the sheet product dispenser 20. The optional power converter 48 may also accept an input from an external power source, such as an alternating current ("AC") power source 50 or a solar power source, or any other alternative power source as may be appropriate for an application. The AC power source 50 may be any conventional power source, such as a 120V, 60 Hz wall outlets for example.

The main controller 38 is a suitable electronic device capable of accepting data and instructions, executing the instructions to process the data, and presenting the results. Main controller 38 may accept instructions through a user interface, or through other means such as but not limited to a proximity sensor, voice activation means, manually-operable selection and control means, radiated wavelength and electronic or electrical transfer. Therefore, main controller 38 can be, but is not limited to a microprocessor, microcomputer, a minicomputer, an optical computer, a board computer, a complex instruction set computer, an ASIC (application specific integrated circuit), a reduced instruction set computer, an analog computer, a digital computer, a molecular computer, a quantum computer, a cellular computer, a solid-state computer, a single-board computer, a buffered computer, a computer network, a desktop computer, a laptop computer, a personal digital assistant (PDA) or a hybrid of any of the foregoing.

Main controller 38 is capable of converting the analog voltage or current level provided by sensors, such as proximity sensor 36 for example, into a digital signal indicative of a user placing their hand in front of the sheet product dispenser 20. Alternatively, proximity sensor 36 may be configured to provide a digital signal to main controller 38, or an analog-to-digital (A/D) converter 52 may be coupled between proximity sensor 36 and main controller 38 to convert the analog signal provided by proximity sensor 36 into a digital signal for processing by main controller 38. Main controller 38 uses the digital signals as input to various processes for controlling the sheet product dispenser 20. The digital signals represent one or more sheet product dispenser 20 data including but not limited to proximity sensor activation, stub roll empty, tear bar activation, motor current, motor back electromotive force, battery level and the like. It should be appreciated that in some embodiments, the main controller 38 may be arranged to also include one or more direct analog inputs to receive one or more analog signals instead of or in addition to digital signals.

Main controller 38 is operably coupled with one or more components of sheet product dispenser 20 by data transmission media 54. Data transmission media 54 includes, but is not limited to, solid-core wiring, twisted pair wiring, coaxial cable, and fiber optic cable. Data transmission media 54 also includes, but is not limited to, wireless, radio and infrared signal transmission systems. Main controller 38 is configured to provide operating signals to these components and to receive data from these components via data transmission media 54. Main controller 38 communicates over the data transmission media 54 using a well-known computer communications protocol such as Inter-Integrated Circuit (I2C), Serial Peripheral Interface (SPI), System Management Bus (SMBus), Transmission Control Protocol/Internet Protocol (TCP/IP), RS-232, ModBus, or any other communications protocol suitable for the purposes disclosed herein.

As will be described in more detail herein, main controller 38 accepts data from sensors, such as stub roll sensor 56 for example, and devices such as motor 42 and electromechanical actuator 58 for example. Main controller 38 is also given certain instructions from an executable instruction set for the purpose of comparing the data from stub rollsensor 56 to predetermined operational parameters. Main controller 38 provides operating signals to electromechanical actuator 58 that activates transfer bar 60.

Main controller 38 includes a processor 62 coupled to a random access memory (RAM) device 64, a non-volatile memory (NVM) device 66, and a read-only memory (ROM) device 68. Main controller 38 may optionally be connected to one or more input/output (I/O) controllers or data interface devices (not shown). NVM device 66 is any form of non-volatile memory such as an EPROM (Erasable Programmable Read Only Memory) chip, a flash memory chip, a disk drive, or the like. Stored in NVM device 66 are various operational parameters for the application code. It should be recognized that application code could be stored in NVM device 66 rather than ROM device 68.

Main controller 38 includes operation control methods embodied in application code. These methods are embodied in computer instructions written to be executed by processor 62, typically in the form of software. The software can be encoded in any language, including, but not limited to, machine language, assembly language, VHDL (Verilog Hardware Description Language), VHSIC HDL (Very High Speed IC Hardware Description Language), Fortran (formula translation), C, C++, Visual C++, Java, ALGOL (algorithmic language), BASIC (beginners all-purpose symbolic instruction code), visual BASIC, ActiveX, HTML (HyperText Markup Language), and any combination or derivative of at least one of the foregoing. Additionally, an operator can use an existing software application such as a spreadsheet or database and correlate various cells with the variables enumerated in the algorithms. Furthermore, the software can be independent of other software or dependent upon other software, such as in the form of integrated software.

Figure 4:
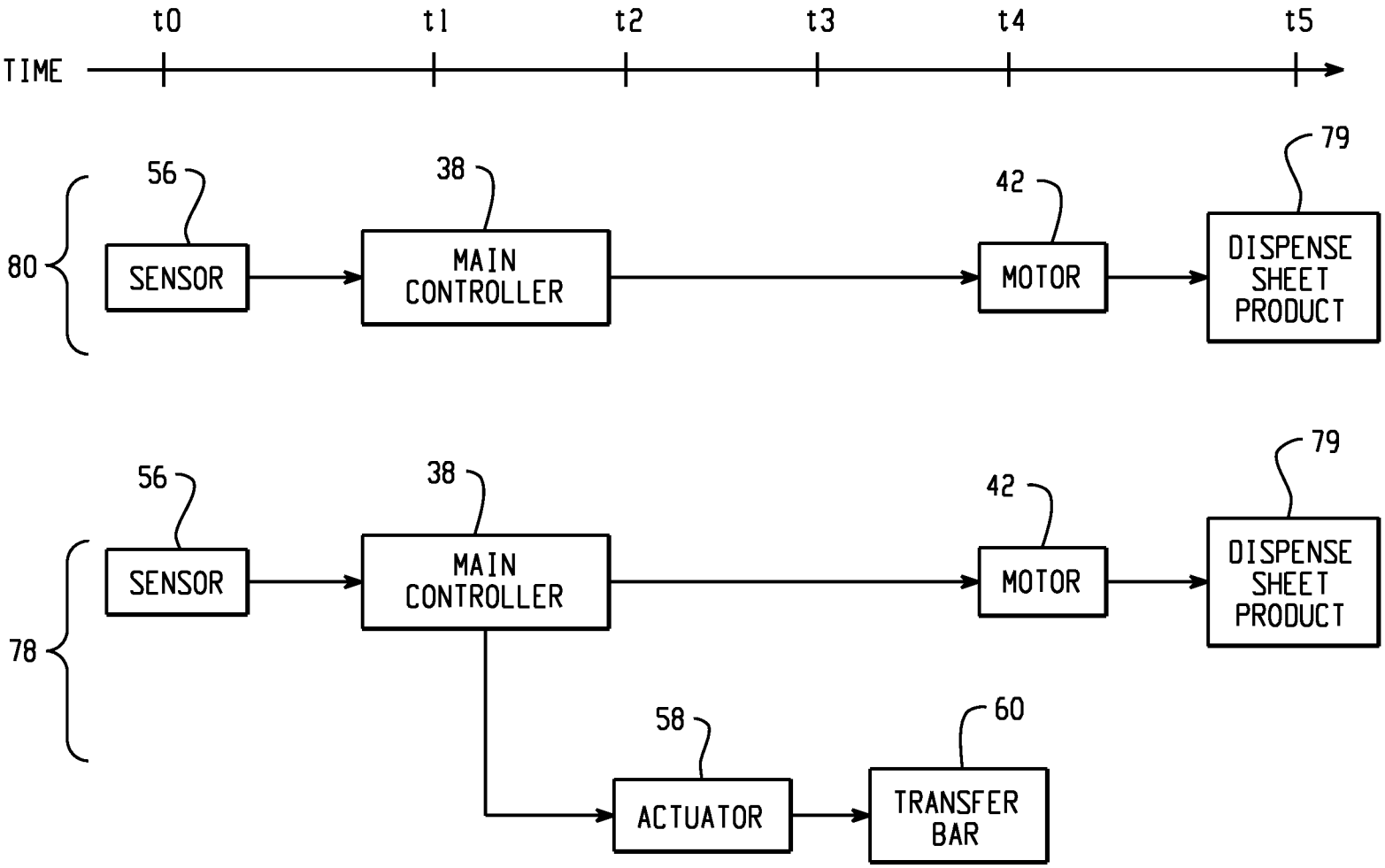
FIG. 4 is a block diagram illustration of the sheet product dispenser of FIG. 1.

Referring now to FIG. 3 and FIG. 4, the dispensing mechanism 40 further includes a transfer bar 60 that is activated by an electromechanical actuator 58. The transfer bar 60 acts to move the end portion of sheet product 26 on main roll 72 from a first position to a second position where it engages the rollers in roller assembly 74 and may be thereafter be dispensed. In the exemplary embodiment, the electromechanical actuator 58 is a motor coupled to an arm by a cam. As the motor rotates, the arm moves between a first position and a second position due to a change in the profile on the cam. In another embodiment (FIGS. 23-25), the electromechanical actuator 58 is a solenoid having a wound coil core and a movable plunger. The plunger moves in response to the core being energized. A spring, or other similar device may be used to return the plunger to its original position once the core is de-energized. The core is electrically coupled to the main controller 38. As will be described in more detail below, the main controller 38 energizes the electromechanical actuator 58 in response to receiving a signal from the stub roll sensor 56.

It should be appreciated that while the present disclosure discusses the electromechanical actuator as having an arm or a plunger that moves in a linear manner, other types of electromechanical actuators may also be used without deviating from the scope of the present embodiments. The electromechanical actuator 58 may be a rotary solenoid, a shape metal alloy, an electro-magnet, or a piezo-electric device for example.

In the exemplary embodiment, the dispensing mechanism 40 also includes at least two sheet products 70, 72 that are mounted on rolls or core stock. Maintenance personnel manually refill the sheet product dispenser 20 and position sheet product 70 within the lower or tapered portion 30. This sheet product 70 is commonly referred to as a "stub roll" since it usually contains only a portion of the sheet product of a new/full sheet product roll. Since the stub roll 70 has less sheet product, it is able to fit within the lower portion of the sheet product dispenser 20. The stub roll 70 feeds sheet product to a roller assembly 74 that includes a pair of rollers that pull the sheet product when activated by motor 42. A tear bar assembly 76 is positioned adjacent the dispensing slot 32 to provide a means for separating the dispensed sheet product 26 from the stub roll 70.

A stub roll sensor 56 is positioned adjacent to the roller assembly 74. As will be described in more detail herein, the stub roll sensor 56 provides a signal to the main controller 38 that indicates whether sheet product is still being dispensed from stub roll 70. It should be appreciated that it is desirable to use as much of the sheet product on stub roll 70 as possible to avoid waste and the related increased costs. The arrangement of providing a stub roll sensor 56 to monitor the dispensing of sheet product 26 provides advantages in that it enables the sheet product dispenser 20 to use all, or almost all of the sheet products on stub roll 70 before switching to main roll 72. This arrangement provides further advantages in that it minimizes or eliminates any gap or overlap in the dispensing of sheet product 26. It should be appreciated that while the stub rollsensor 56 may be described herein as being positioned on the in-feed side of the rollers in roller assembly 74, the sensor may be positioned on the out-feed side of the rollers as well.

After the roller assembly 74 pulls the sheet product from either the stub roll 70 or the main roll 72, the sheet product 26 proceeds to tear bar assembly 76. The tear bar assembly 76 is positioned adjacent the dispensing slot 32. A means for cutting the sheet product 26 is included in tear bar assembly 76 once the appropriate amount of sheet product 26 has been dispensed. Typically, this is accomplished using a serrated edge that cuts into the sheet when the user pulls the dispensed sheet product 26. The separation of the sheet product 26 from the stub roll 70 or main roll 72 may then be used and discarded as necessary by the user.

The operation of the sheet product dispenser 20 may be thought of as a series of dispensing cycles 78 as shown in FIG. 4. Upon the activation of proximity sensor 36, at time t0 for example, a signal is transmitted from sensor 36 to the main controller 38. The main controller 38 executes instructions in response to the signal and executes one or more routines to activate the motor 42 (time=t2). The motor 42 in turn rotates one of the rollers in roller assembly 74 (time=t3). The rotation of the roller causes the sheet product 26 to be pulled from the stub roll 70 until the desired amount of sheet product 26 has been dispensed 79 from the sheet product dispenser 20 (time=t5). The sheet product 26 is separated from the stub roll 70 via tear bar assembly 76.

During the dispensing cycle, it is possible that the sheet product 26 contained on stub roll 70 will be expended or otherwise depleted. As discussed above, the stub roll sensor 56 is arranged to detect the presence of the sheet product 26 at either the in-feed or out-feed portion of the roller assembly 74. Once the sheet product 26 from stub roll 70 is not detected by stub roll sensor 56 (time=t0), the sheet product dispenser 20 enters a transfer cycle 80 as shown in FIG. 4. In the transfer cycle 80, a signal is transmitted from stub roll sensor 56 to main controller 38 (time=t1). The main controller 38 executes instructions in response to the signal from stub roll sensor 56 to energize electromechanical actuator 58. The activation of electromechanical actuator 58 causes transfer bar 60 to move the edge of the sheet product 26 for main roll 72 from a first position to a second position where the edge engages the roller assembly 74 (time=t3 to t4). Once the edge of the main roll 72 is engaged, the main controller 38 activates the motor 42 to drive the roller assembly 74. The motor 42 is operated for a desired amount of time, typically enough time to dispense 79 a predetermined amount of sheet product 26, 12 inches for example, to ensure the main roll 72 sheet product 26 has been engaged in the roller assembly 74. The electromechanical actuator 58 and transfer bar 60 then move back to the first position in preparation for maintenance personnel to refill the sheet product dispenser 20.

It should be appreciated that the above described sequences 78, 80 may occur simultaneously, where for example, the user activates the proximity sensor 36 and the stub roll 70 has already been expended. Alternatively, the stub roll 70 may become expended during the dispense cycle 78 and the sheet product dispenser 20 switches to transfer cycle 80 in order to allow a sufficient amount of sheet product 26 to be dispensed.

An exemplary dispenser mechanism 40 is shown in FIGS. 5-8. In this embodiment, the dispenser mechanism 40 includes a chassis 82 that is configured to couple to the backplate 24. The chassis 82 includes a pair of roll holders 84, 86 that each includes a projection 88 sized to receive the core of a main-sheet product roll 72. The chassis 82 also includes a well area 90 that is sized to fit a stub roll (not shown). The roller assembly 74 is positioned within the chassis 82 between the proximity sensor 36 and a battery housing 92. As discussed above, the roller assembly 74 delivers the sheet product 26 from the main sheet product roll 72 or stub roll 70 to the dispensing slot 32 to make the sheet product 26 available to the user. The dispenser mechanism 40 also includes a drive motor assembly 92, a transfer bar assembly 94 and a sheet length assembly 96 as will be discussed in more detail herein.

The proximity sensor 36 initiates the operation of the sheet product dispenser 20. Alternatively, in the embodiments operating in a "hang mode", the operation is initiated by the actuation of the tear bar. In the exemplary embodiment, the proximity sensor 36 is integrated with the main controller 38. The main controller 38 is between a front shroud 98 and the roller assembly 74. The proximity sensor 36 includes an optical emitter 100 and a receiver 102. A lens 103 that is substantially flush with the front shroud 98 covers the emitter 100 and receiver 102. The emitter 100 and receiver 102 are spaced apart on the main controller 38 and oriented on an angle relative to the front of the sheet product dispenser 20. The emitter 100 transmits an optical signal, such as an infrared light for example, in a beam that extends outward on an angle 104 forming an emitter cone 108, shown in FIG. 8. Similarly, the receiver 102 is responsive to signals received from a direction that extends outward on an angle 106 forming a receiver cone 110. The overlapping of the emitter cone 108 and the receiver cone 110 creates a four-sided polyhedron shaped area 112 that represents an area where a user may place their hands to activate the sheet product dispenser 20. It should be noted that said polyhedron represents the area of high probability for triggering the dispenser. Areas outside the polyhedron shaped area 112, but still with the area of one of the cones 108, 110, may still result in triggering the dispenser, however, these areas may be less reliable or consistent than the area 112.

It should be appreciated that the position of the area 112 will affect the functioning and the user experience with the sheet product dispenser 20. The area 112 needs to be large enough to allow the user an easy operation of the sheet product dispenser 20 without having the farthest distance "D" of the area 112 extend too far from the sheet product dispenser 20. While a large area is desirable, if the distance "D" becomes too large, someone passing by may accidentally dispense the sheet product 26. Further, the larger the area 112, the more quiescent power the proximity sensor 36 will use, decreasing battery life. In the exemplary embodiment, the emitter 100 and the receiver 102 are spaced a distance "W" of 3 inches (7.62 cm) apart on an angle of from 10 to 80 degrees. This creates a polyhedron area 112 having a maximum distance "D" of 3 inches. The advantage of this arrangement is that it creates an area 102 that is large, reliable and convenient enough for the user while keeping the quiescent power requirements at less than or equal to 25% of the annual battery usage.

Figure 9:
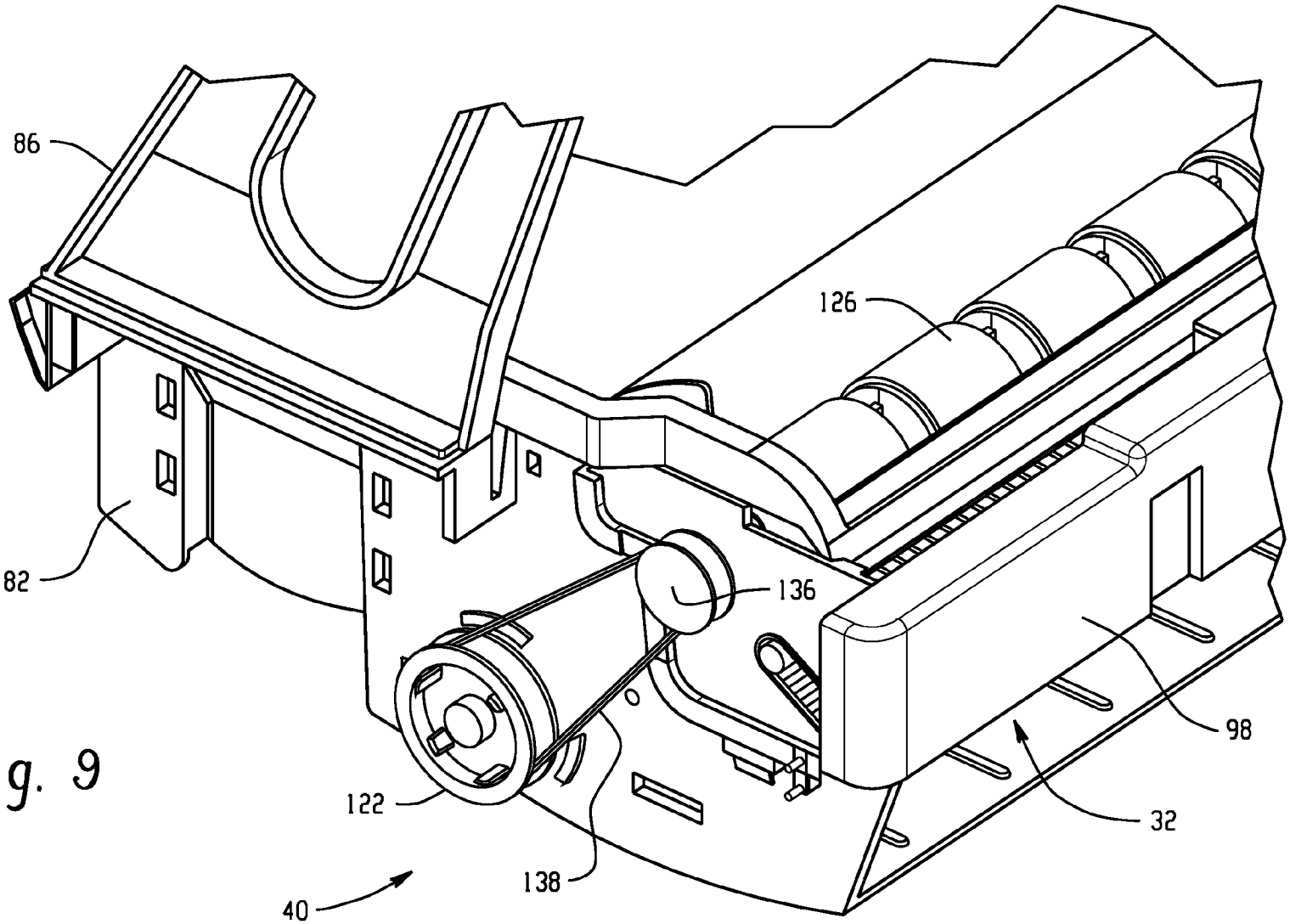
FIG. 9 is a partial perspective view illustration of the dispensing mechanism of FIG. 4.
Figure 10:
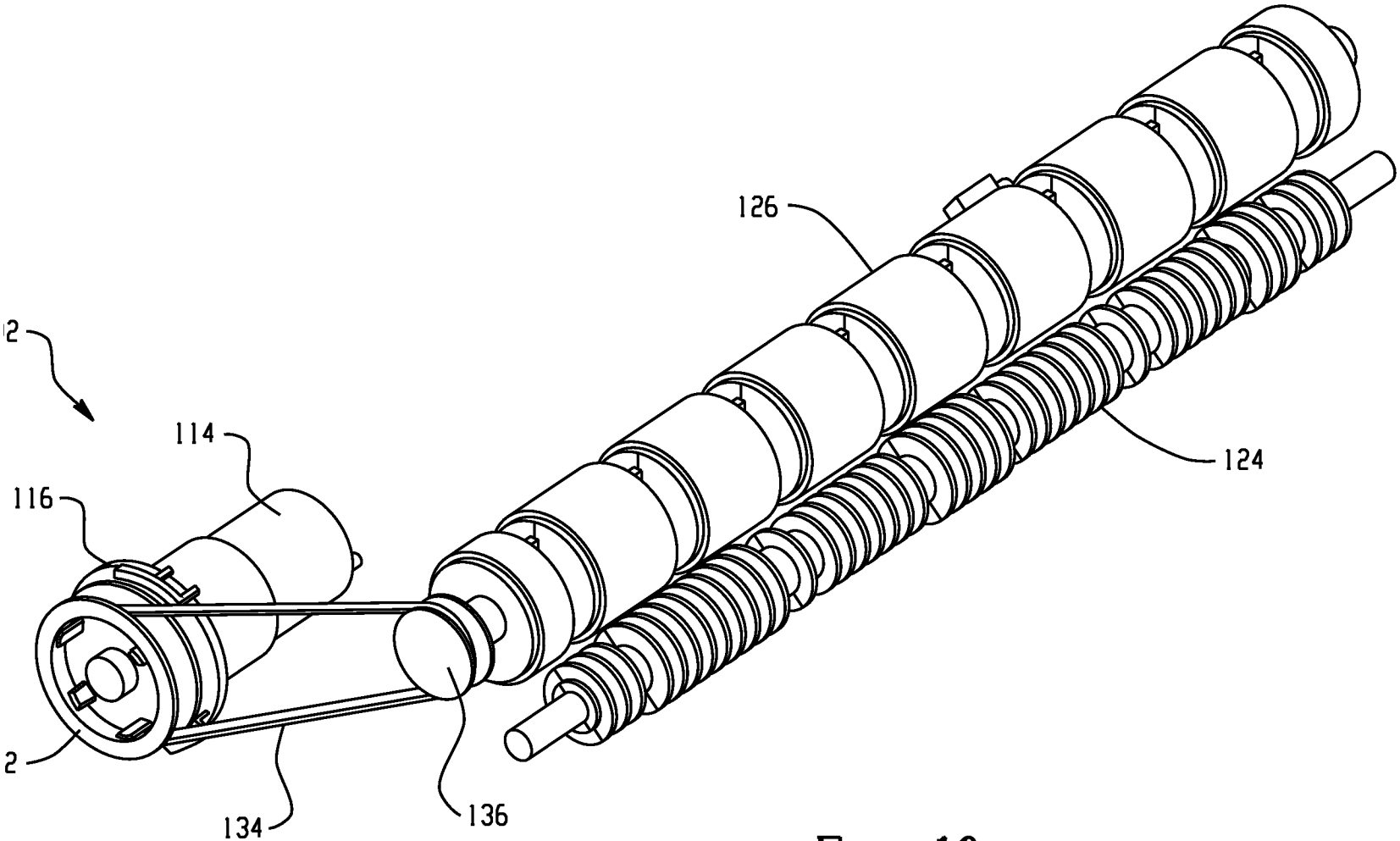
FIG. 10 is a partial perspective view illustration of an embodiment of a sheet transfer mechanism for the dispenser mechanism of FIG. 4.
Figure 11:
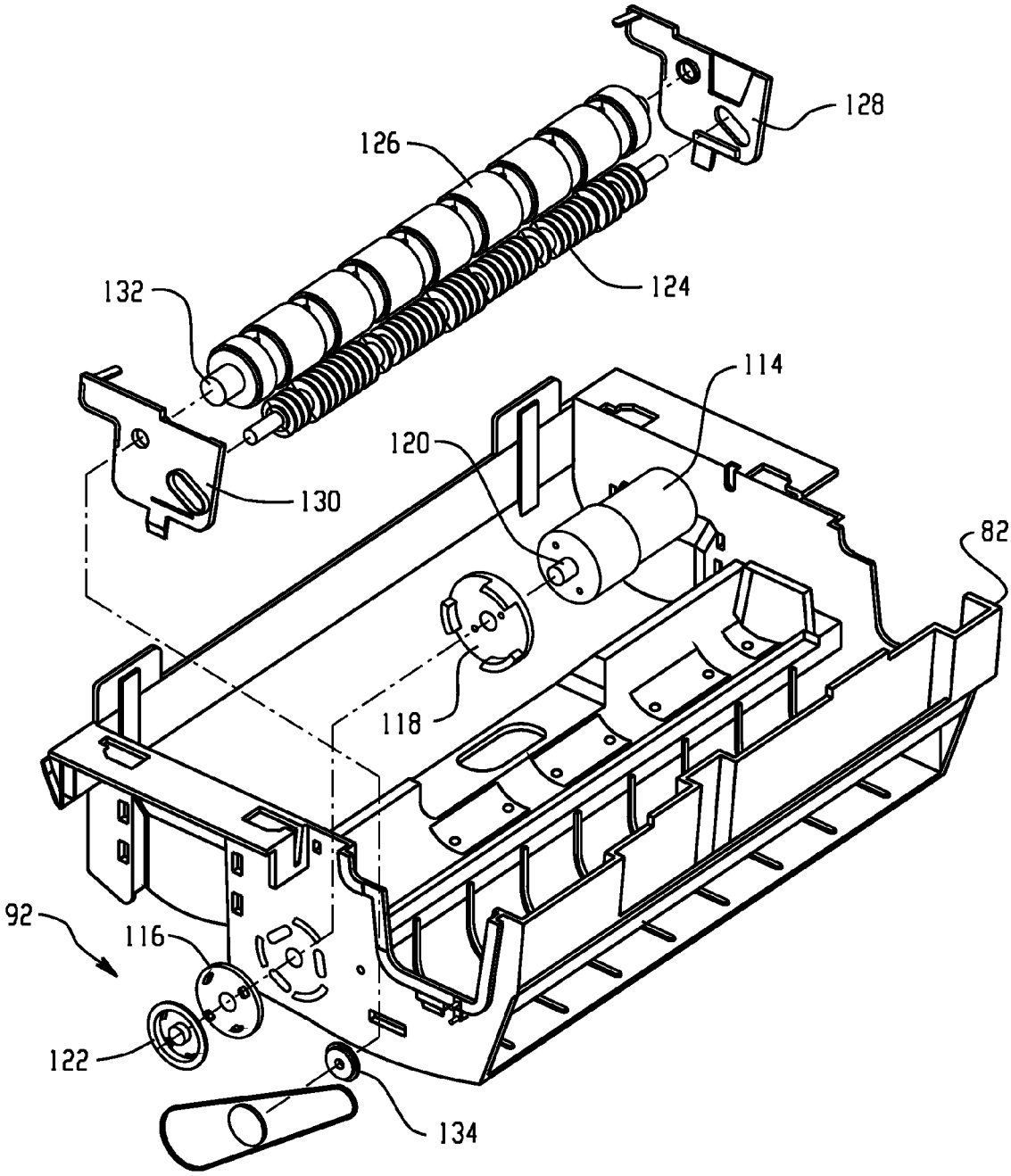
FIG. 11 is an exploded view illustration of the sheet transfer mechanism of FIG. 4.

Referring now to FIGS. 9-11, the drive motor assembly 92 will be described. As discussed above, when the user activates the proximity sensor 36 (FIG. 2), a signal is transmitted to the main controller 38 (FIG. 2), which activates the drive motor assembly 92 (FIG. 6) to dispense the sheet product 26. The drive motor assembly 92 includes a motor 114 coupled to the chassis 82 by a flange 116. An isolator 118 is arranged between the motor 114 and chassis 82. In the exemplary embodiment, the isolator is a rubber based polymer such as butadiene for example, having hardness in the range of the Shore A scale. The isolator provides damping to prevent transmission of vibrations from the motor into the chassis 82 and a front cover 22 (FIG. 1). The motor 114 includes a shaft 120 that extends through an opening in the chassis 82. A pulley 122 is mounted to the shaft 120. In the exemplary embodiment, the pulley 122 includes teeth sized to receive a toothed belt.

The roller assembly 74 (FIG. 7) includes a pinch roller assembly 124 and a drive roller assembly 126. Each of the roller assemblies 124, 126 are rotatably coupled to a side plate 128, 130 that in turn mounts to the chassis 82. The drive roller assembly 126 rotates about a shaft 132. A pulley 134 is mounted to the end of the shaft 132 adjacent the motor 114. The pulley is secured to the shaft 132 by a drive flange 136.

A belt 138 couples the pulleys 122, 134. In the exemplary embodiment, the belt 138 is a toothed belt. The teeth on the belt 138 have a size and pitch suitable to engage the teeth on the pullies 122, 134. In the exemplary embodiment, the belt 138 is made from a suitable material, including but not limited to: Neoprene, polyurethane, rubber, and urethane, reinforced with materials including but not limited to: polyaramid, glass, metallic fibers, other polymers fibers, or other reinforcing fibers. The combination of the belt 138 and the isolator 118 provides advantages over the prior art systems that use direct gear arrangement between the motor 114 and the drive roller assembly 126*r*. While the gear systems provide a greater efficiency in the transfer of energy from the motor 114 to the drive roller assembly 126, backlash and vibration in this arrangement creates an undesirable noise. The noise is transferred into the dispenser housing, such as front cover 22 for example, which acts as an amplifier. By using an isolator 118 and a belt, transfer of vibrations from the motor 114 is minimized resulting little or no sound emissions from the sheet product dispenser 20.

Figure 12:
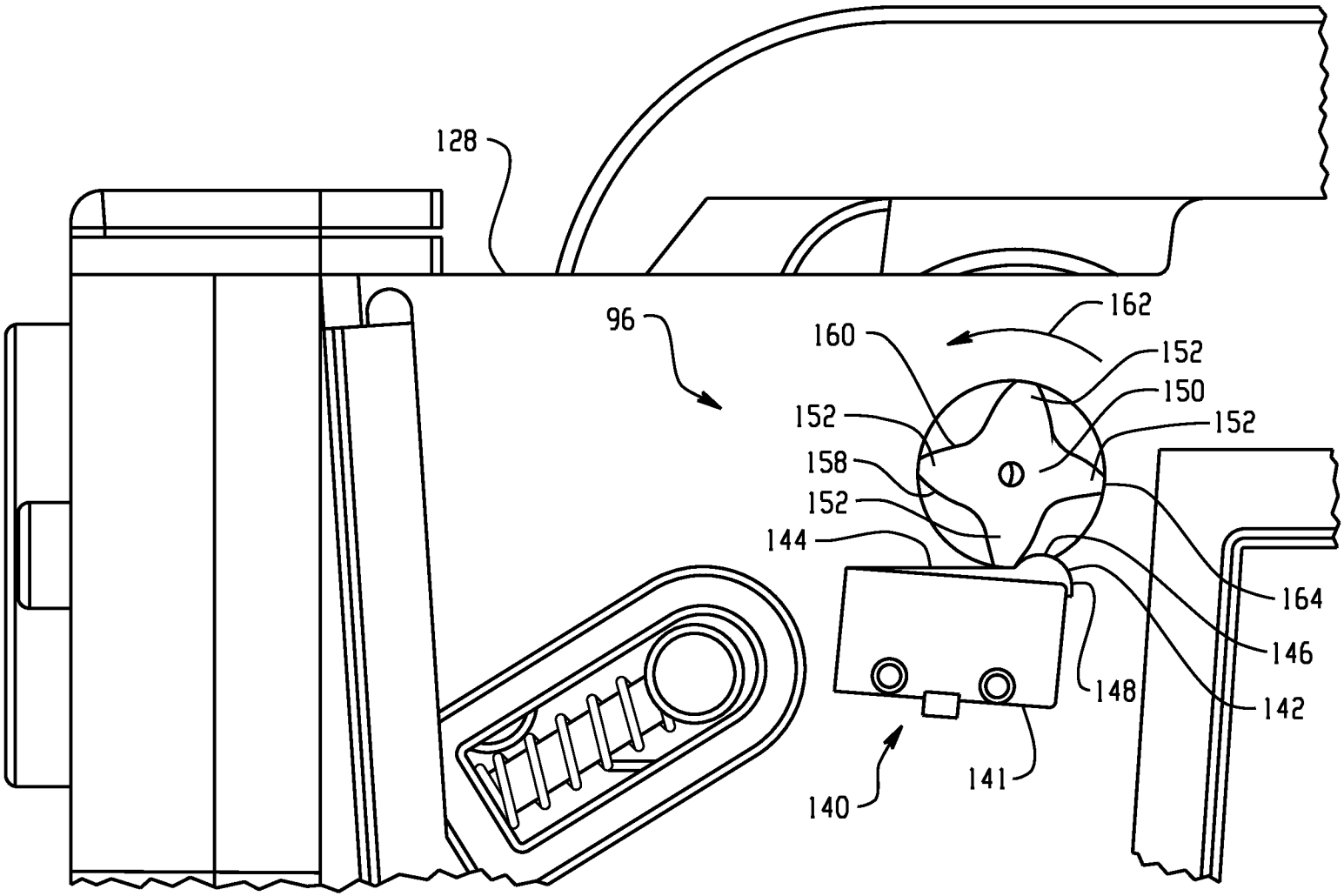
FIG. 12 is a partial side plan view illustration of the dispensing mechanism of FIG. 4.
Figure 13:
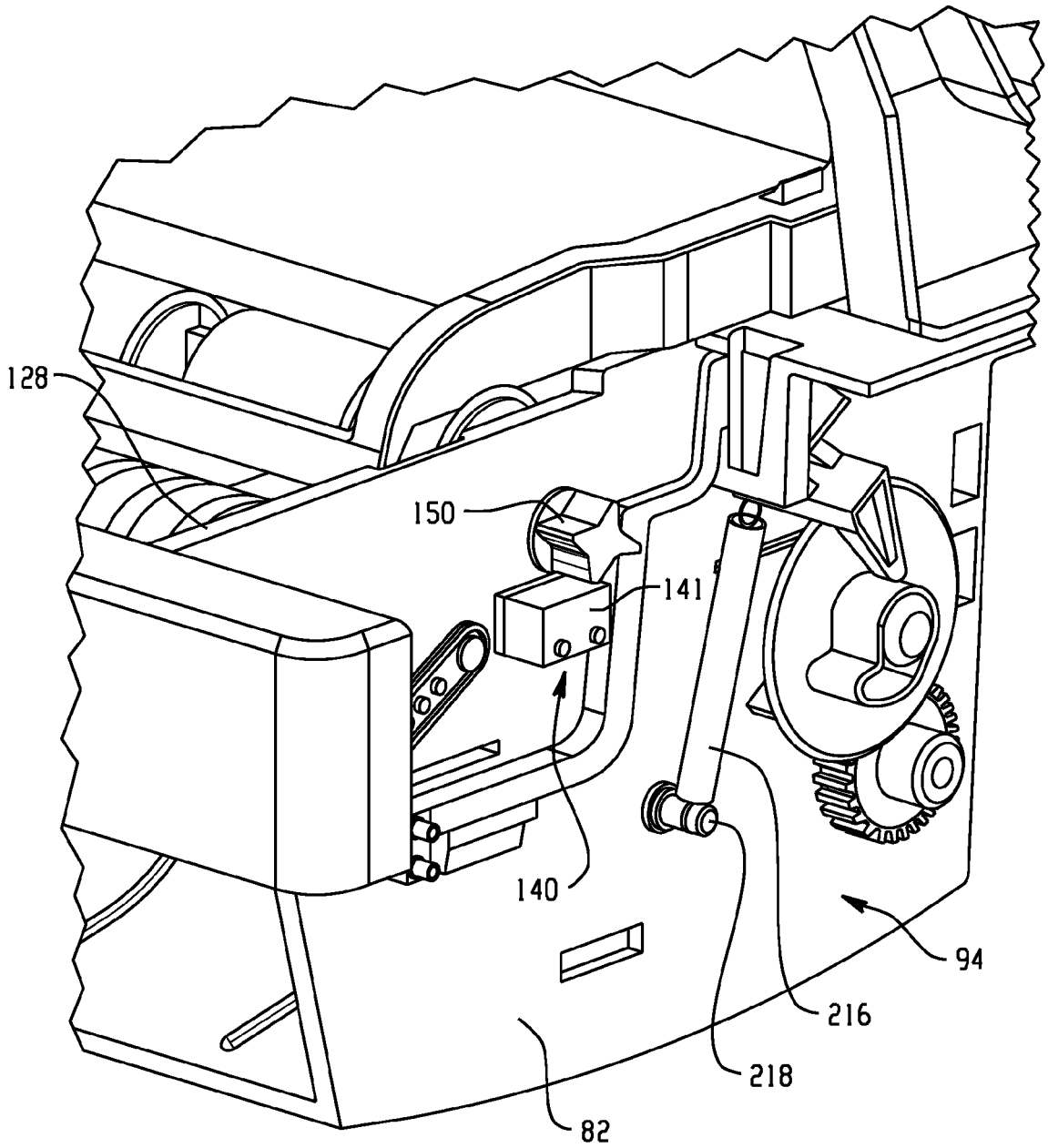
FIG. 13 is a partial perspective view illustration of the dispensing mechanism of FIG. 12.

It should be appreciated that it is desirable to provide a consistent amount of sheet product 26 to the user each time the sheet product dispenser 20 is operated. To measure the amount of sheet product 26 being dispensed, the dispenser mechanism 40 includes a sheet length assembly 96 as shown in FIGS. 12-13. The sheet length assembly 96 is arranged adjacent the drive roller assembly 126, opposite the drive motor assembly 92. The sheet length assembly 96 includes a switch 140 mounted to side plate 128. The switch 140 includes a switch body 141 and an arm 142 having a first portion 144 that extends to a contact portion 146 having an arcuate surface. Extending from the contact portion 146, the arm 140 includes a second portion 148. In the exemplary embodiment, the second portion 148 is substantially perpendicular to the first portion 144.

The contact portion 146 engages a cam 150 having a plurality of lobes 152. The cam 150 is coupled to the drive roller shaft 132 and is arranged to rotate with the drive roller assembly 126. In the exemplary embodiment, the cam 150 has four lobes 152. Each of the lobes 152 includes a first surface 158 and a second surface 160. During normal operation, the drive roller assembly 126 rotates in the direction indicated by arrow 162. As the cam 150 rotates with the drive roller assembly 126, the contact portion 146 of the switch arm 142 engages the first surface 158 and displaces toward the switch body 141. As the arm 142 displaces, the first portion 144 actuates a switch mechanism (not shown) closing a circuit to generate a signal. In the exemplary embodiment, the signal is generated near, or just prior to the contact portion 146 reaching the intersection 164 of the first surface 158 and second surface 160. The switch 140 is electrically coupled to transmit the signal to the main controller 38. The main controller 38 may then count the number of signals to determine the number of rotations of the drive roller assembly 126 and thus the amount of paper dispensed. Once the appropriate amount of sheet product 26 has been dispensed, the main controller 38 deactivates the drive motor 114, which stops the dispensing of the sheet product 26.

In the event the drive roller assembly 126 is rotated in a direction opposite that indicated by arrow 162, such as if maintenance personnel pull the sheet product 26 out from between the drive roller assembly 126 and the pinch roller assembly 124 for example, the arm second portion 148 comes into contact with the cam second surface 160. The second surface 160 is angled to allow the second portion 148 to slide up the second surface 160 until the contact portion 146 engages the second surface 160. As the counter-rotation continues, the contact portion 146 crosses the intersection 164. The angle of the second surface 160, the arm second portion 148 and the contact portion 146 cooperate to allow the reversal of the cam 150 without damaging the switch 140.

As discussed above, during typical operations, the sheet product 26 is first dispensed from the stub roll 70. In the exemplary embodiment, the stub roll 70 is placed in the lower portion of the sheet product dispenser 20, such as in the well area 90 for example. The leading edge of the sheet product 26 is placed into the location where the drive roller assembly 126 and the pinch roller assembly 124 meet, a location commonly referred to as the "nip". After a period of time, the sheet product 26 in the stub roll 70 will be depleted. As will be discussed in more detail below, the dispenser mechanism 40 includes a transfer bar assembly 94 that moves the sheet product 26 from the main roll 72 into the nip allowing the drive roller assembly 126 and the pinch roller assembly 124 to pull the sheet product 26 from the main sheet product roll 72.

Figure 14:
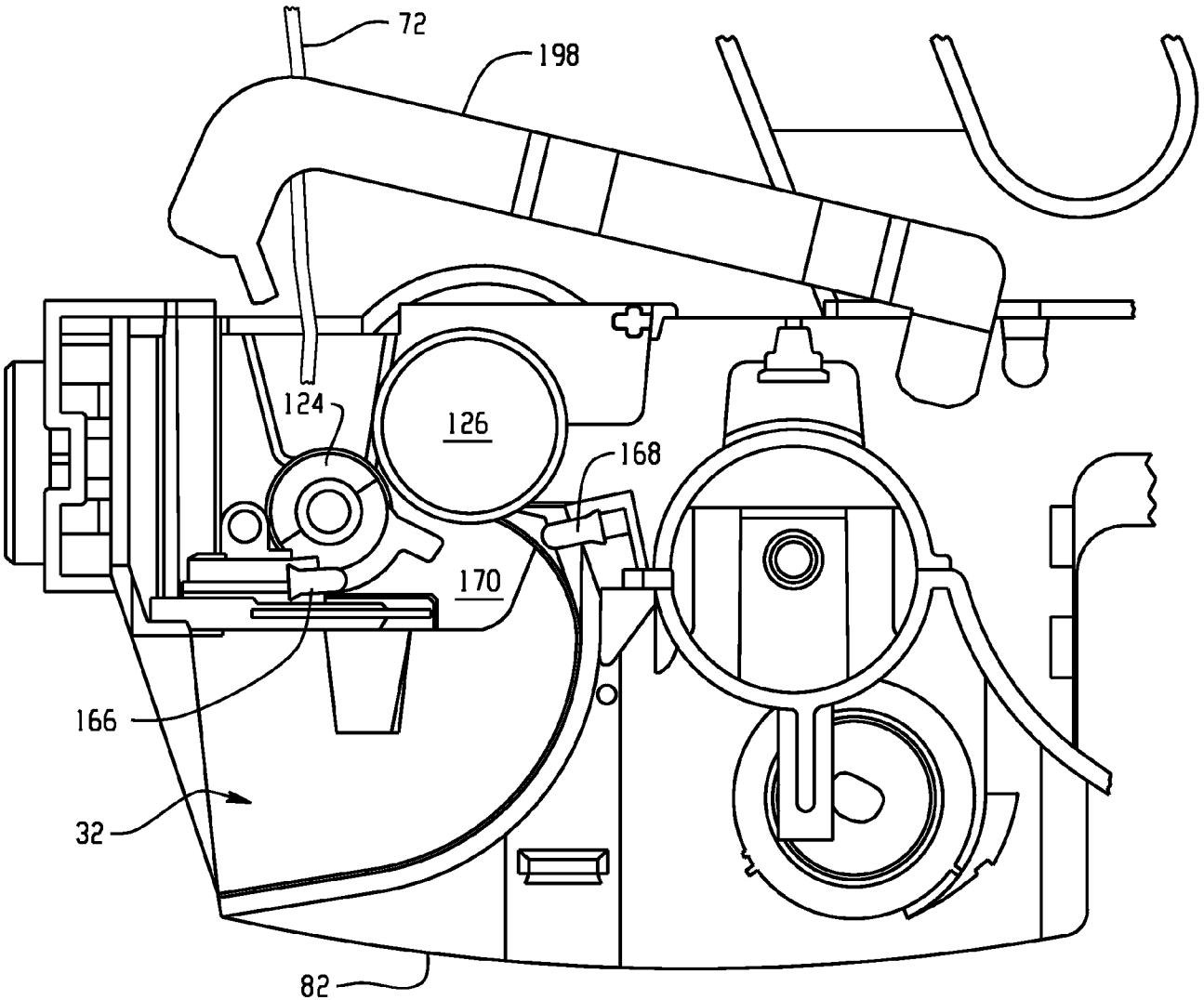
FIG. 14 is a side plan sectional view along the line 14-14 illustrating an embodiment of a sheet detector arrangement for the dispensing mechanism of FIG. 4.

It should be appreciated that it is undesirable to not have sheet product 26 available due to the depletion of the stub roll 70. To determine when the stub roll 70 is depleted, the dispenser mechanism 40 includes a sensor that detects the presence of sheet product 26 in a path the sheet product 26 follows while being dispensed. An exemplary sensor arrangement 164 is illustrated in FIG. 14. In this embodiment, an optical sensor having an optical emitter 166 is arranged to transmit a light to an optical receiver 168 in an area 170 located below the roller assemblies 124, 126. The area 170 lies within the path the sheet product 26 follows during dispensing. When sheet product 26, such as from stub roll 70 is present, the sheet product 26 blocks the light from being received by the optical receiver 168. Thus, once the stub roll 70 is depleted, the optical receiver 168 detects light from the optical emitter 166 and transmits a signal to the main controller 38.

Figure 15:
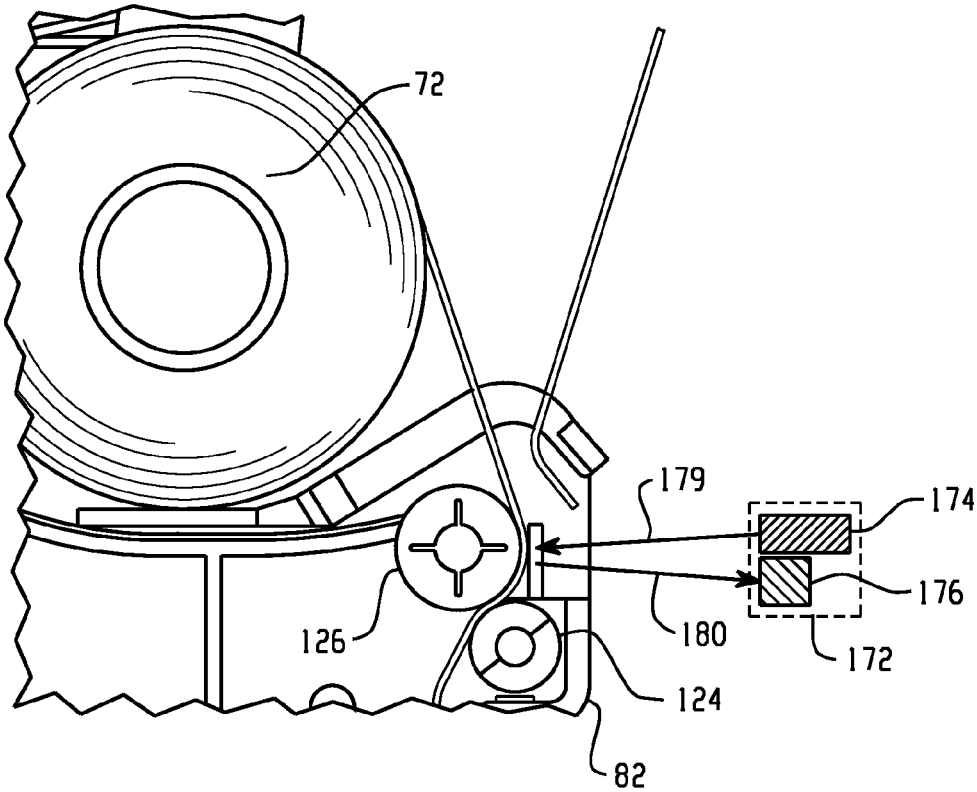
FIG. 15 is a partial side plan view illustration of another embodiment of a sheet product sensing arrangement for the dispensing mechanism of FIG. 5.

Another embodiment of a sheet product 26 depletion sensor is shown in FIG. 15. In this embodiment, the sensor is an optical sensor, such as an infrared detector 172. An infrared detector 172 includes an emitter 174 and a receiver 176. The detector 172 is positioned adjacent the feed roller assembly 126 with the emitter 174 positioned to direct the infrared light towards the drive roller assembly 126. In one embodiment, the detector is positioned between the drive roller assembly 126 and the front cover 22, such that the light strikes the three o'clock position of the drive roller assembly 126 as shown in FIG. 15 as indicated by the arrows 179, 180. The drive roller assembly 126 is made from a black or other dark color material that reduces or eliminates the reflection the light emitted from emitter 174. Alternatively, the drive roller assembly 126 may have a surface, or coating on the surface that is nonreflective to infrared wavelengths of light. Such a coating may be aluminum oxide (Al2O3), aluminum oxide-titanium oxide mixtures (Al2O3-TiO), chromium oxide-aluminum oxide mixtures, tungstencarbide-cobalt mixtures (WC/Co), silver bromide, or silver chloride for example. It should be appreciated that optical detectors that utilize a different wavelength of light may also be used without deviating from the scope of the present invention.

Reducing or eliminating the reflection of light emitted from the detector 172 may ascertain the presence of sheet product 26 entering the nip of roller assemblies 124, 126. Thus, when sheet product 26 is present the emitted light would reflect back to the receiver 176 indicating to the main controller 38 that the stub roll 70 was still dispensing sheet product 26. Conversely, when there is no sheet product 26, such as when the stub roll 70 is depleted, the receiver 176 would not receive a light reflection and a signal would be transmitted to the main controller 38. It should be further appreciated that while the infrared detector 172 is illustrated as two separate components, the detector 172 may also be manufactured as a single integrated device.

Figure 16:
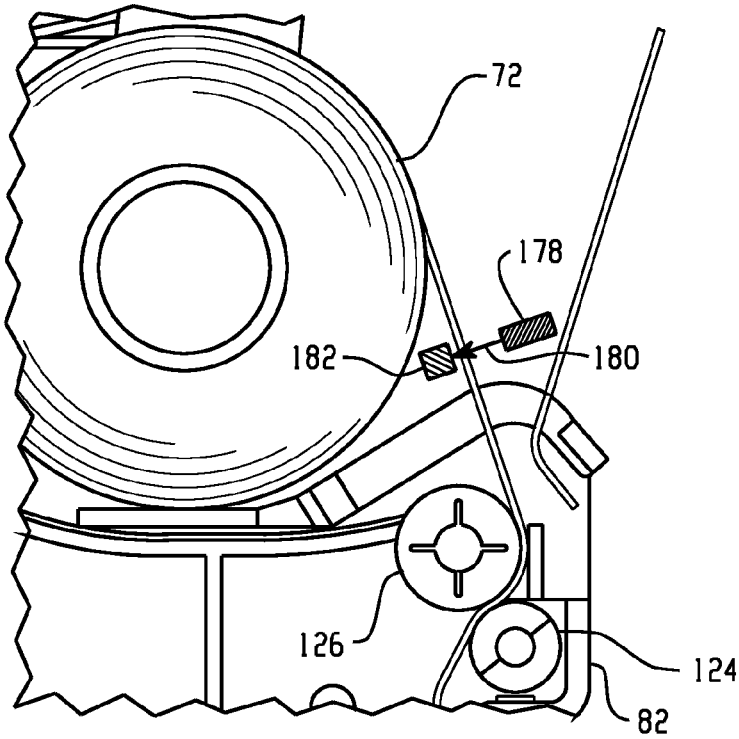
FIG. 16 is a partial side plan view illustration of another embodiment of a sheet product sensing arrangement for the dispensing mechanism of FIG. 5

An alternate embodiment sensor arrangement is illustrated in FIG. 16. In this embodiment, similar to the embodiment shown in FIG. 14, an optical transmitter 178 is positioned to one side of the sheet product 26 path. The transmitter 178 is arranged to transmit the light, such as an infrared light for example, across the sheet product 26 path, as indicated by the arrow 180, to a receiver 182 positioned opposite the transmitted 178. When the stub roll 70 is dispensing sheet product 26, the sheet product 26 blocks the path of the infrared light. The lack of light at the receiver 182 indicates to the main controller 38 that the stub roller still holds sheet product 26. Once light is received by the receiver 182, a signal is transmitted to the main controller the transfer bar assembly 94 is activated causing sheet product 26 from the main roll to be dispensed.

Figure 17:
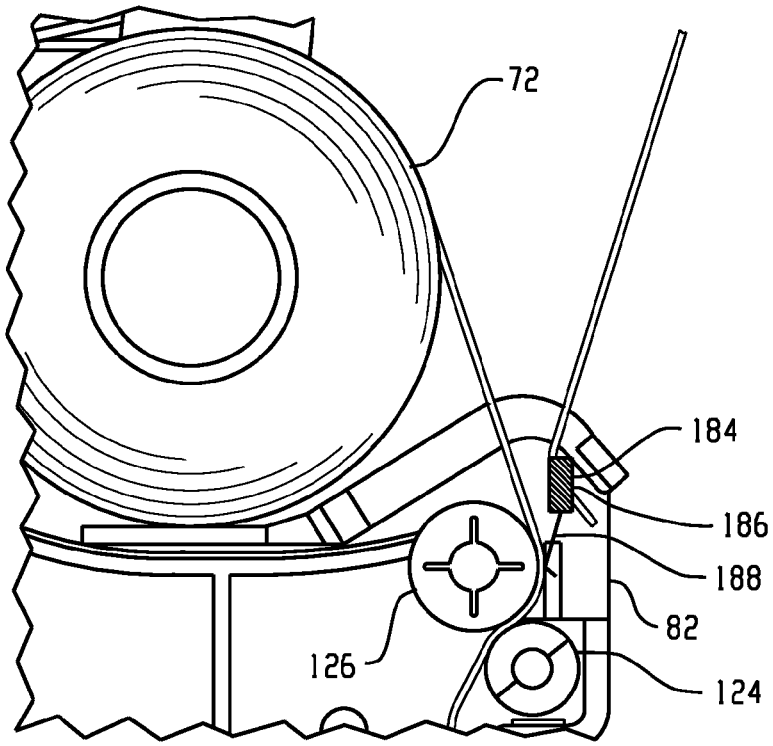
FIG. 17 is a partial side plan view illustration of another embodiment of a sheet product sensing arrangement for the dispensing mechanism of FIG. 5.

Another sensor embodiment is shown in FIG. 17. In this embodiment, a switch 184 is used to indicate the presence of sheet product 26 from the stub roll 70. The switch 184 includes a body portion 186 that contains a mechanical switch that makes and breaks electrical contact of a circuit. An arm 188 extends from the body 186. The arm 188 has first and second position and is arranged to act as an indicator such that when there is sheet product 26 entering the nip from the stub roll 70, the arm 188 is in a first position. When the sheet product 26 is no longer present, such as when the stub roll 70 is depleted, the arm 188 moves to a second position. Typically, the arm 188 is pre-tensioned, when in the first position, by a plunger (not shown) that is part of the mechanical switch in the body 186. The movement to the second position transmits a signal to the main controller 38 that indicates the stub roll 70 has been depleted.

It should be appreciated that the position of the sensor as described in the embodiments shown in FIGS. 14-17 may be positioned anywhere within the sheet product dispenser 20 where the sensor can detect the presence of sheet product 26 entering the nip from the stub roll 70. For example, the optical emitter 166 and optical receiver 168 may be place anywhere the light from the optical emitter 166 can intercept the sheet product path of main sheet product roll 72 adjacent to the drive roller assembly 126. The positioning of the sensor as shown in FIGS. 14-17 is exemplary and not intended to be limiting.

Figure 18:
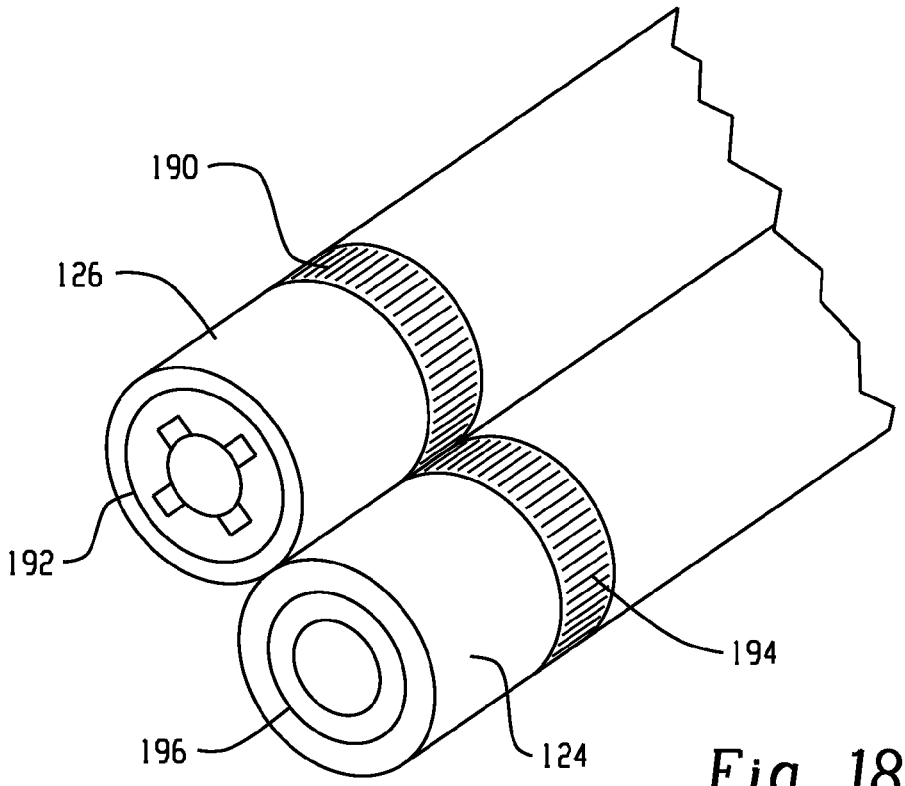
FIG. 18 is a partial perspective view illustration of another embodiment of sheet product sensing arrangement for the dispensing mechanism of FIG. 5.
Figure 19:
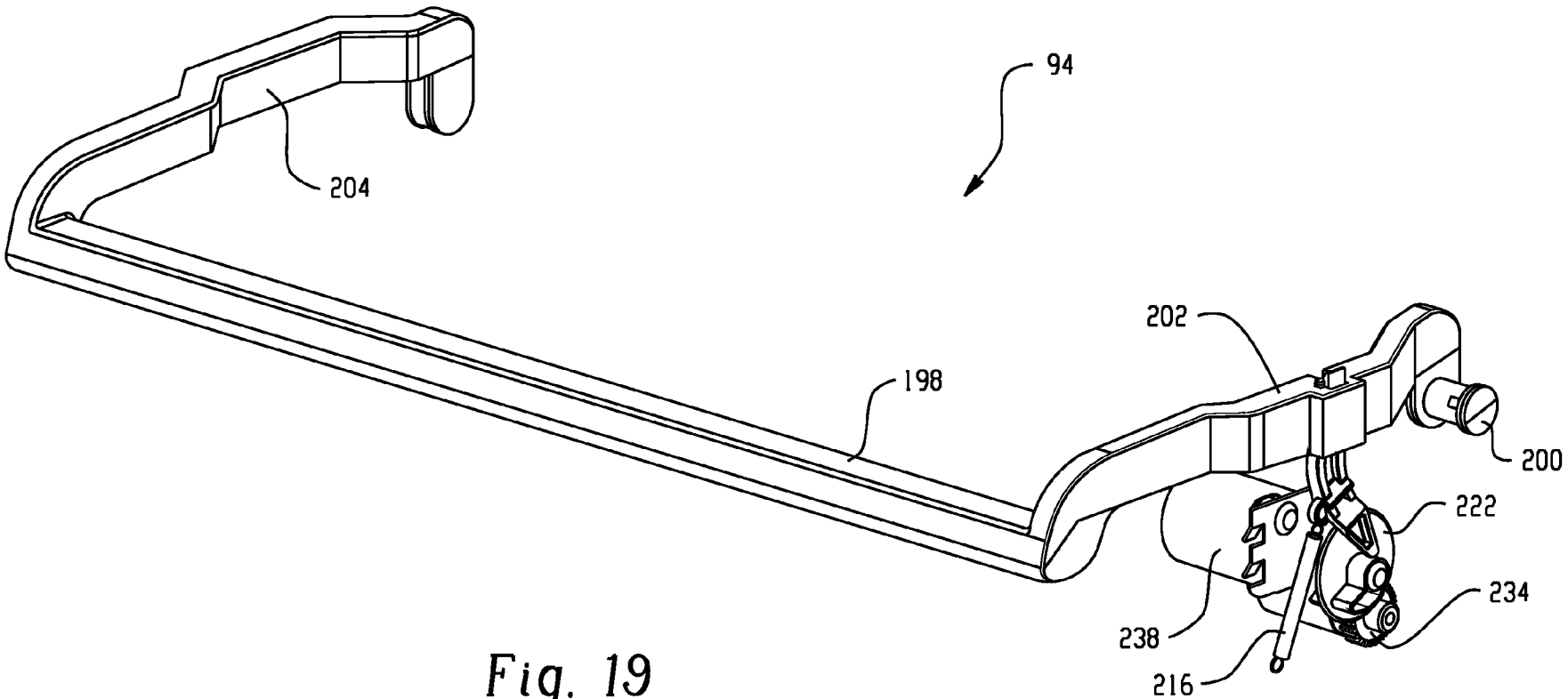
FIG. 19 is a partial perspective view illustration of a transfer bar assembly for the dispensing mechanism of FIG. 5.
Figure 20:
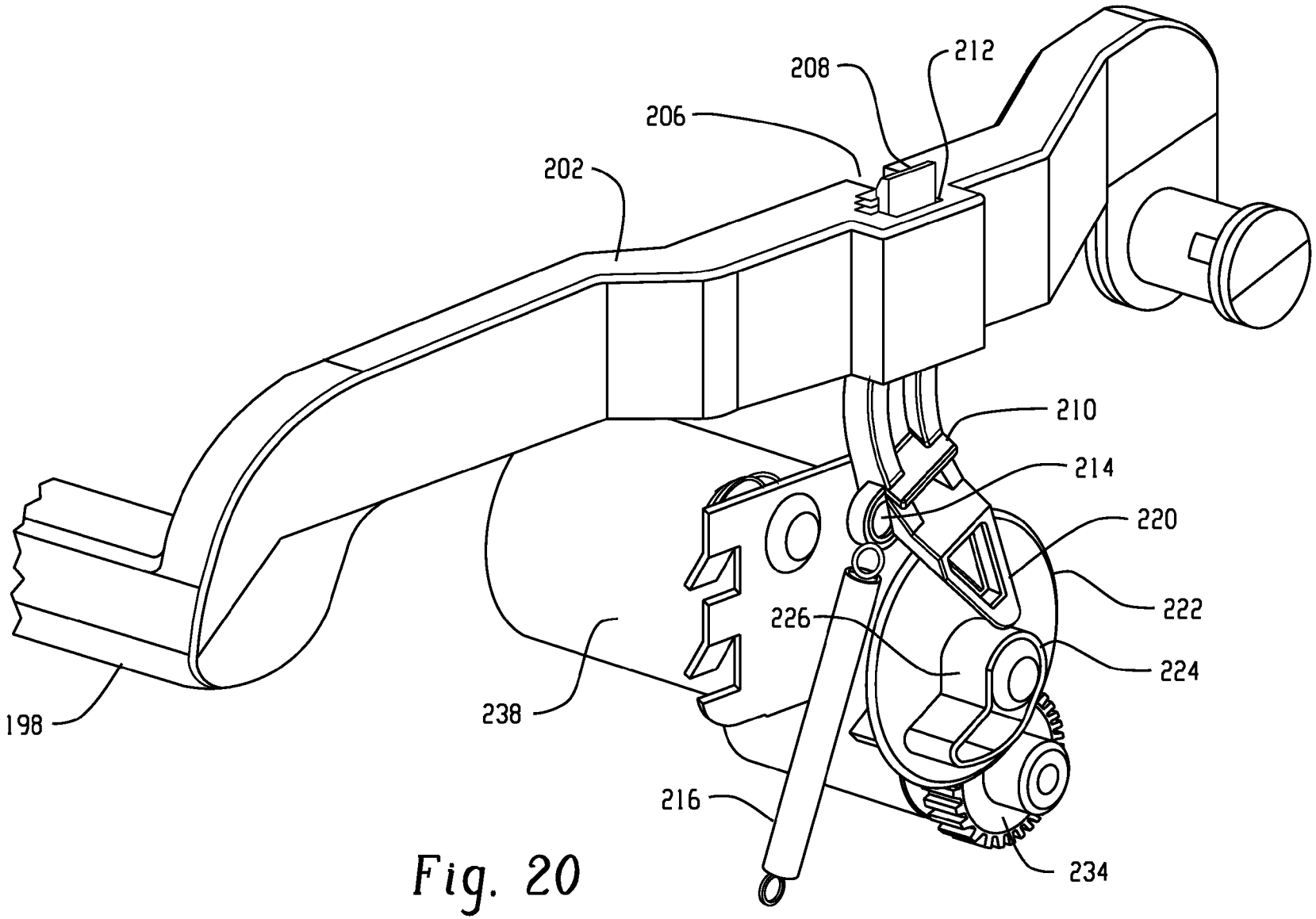
FIG. 20 is a partial perspective view illustration of the transfer bar assembly of FIG. 19.
Figure 21:
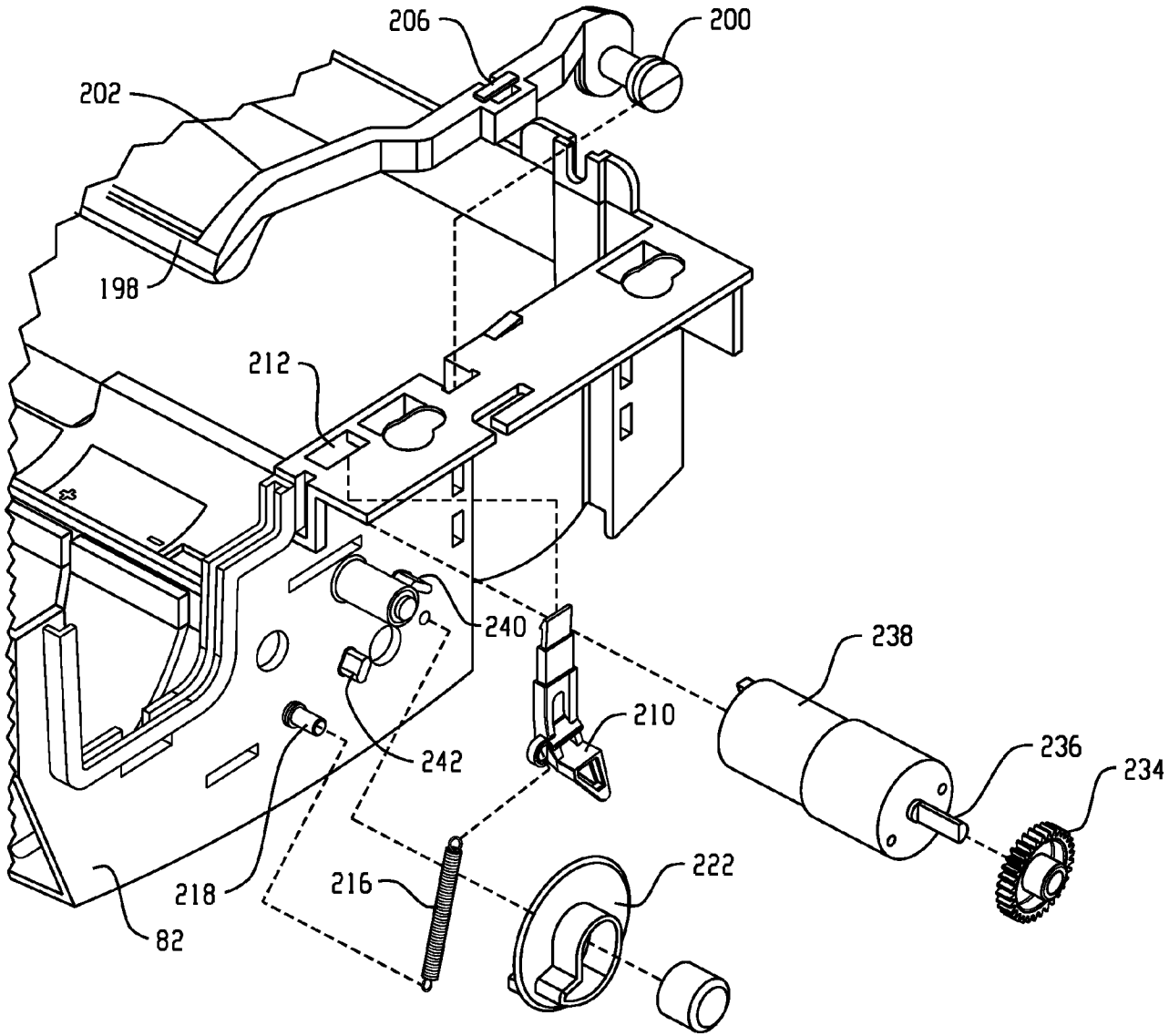
FIG. 21 is an exploded view illustration of the transfer bar assembly of FIG. 19.
Figure 22:
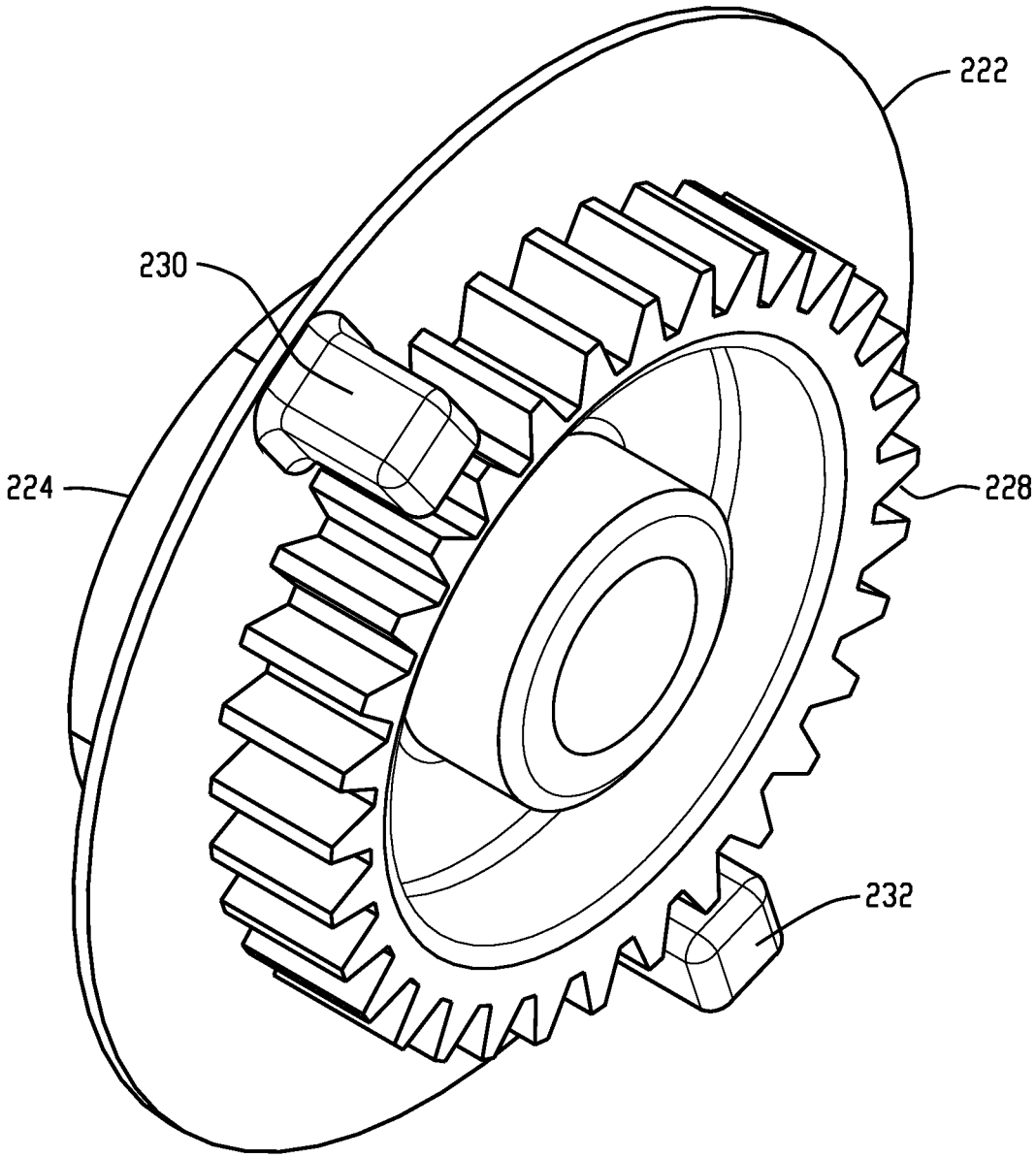
FIG. 22 is a perspective view illustration of an exemplary cam for the transfer bar assembly of FIG. 19.

Another alternate embodiment sensor is shown in FIG. 18. In this embodiment, a first conductive ring 190 is mounted to the drive roller assembly 126. The first conductive ring 190 may be mounted to the drive roller assembly 126 by any suitable means, including but not limited to a press fit or bonding for example. The first conductive ring 190 may be made from any suitable material, including but not limited to metals such as copper, aluminum, silver, or gold. The first conductive ring 190 may also be made from a conductive polymer, such as but not limited to conductive polyacetylenes, polyacetylene, polypyrrole, polyaniline, melanin, or other polymer resins impregnated with carbon dust or fiber. The first conductive ring 190 may also be made from a less conductive material such nickel and plated with a more conductive material, such as the aforementioned metals or conductive plastics. The first conductive ring 190 is electrically coupled to the main controller 38, such as by a slip ring 192 for example. Slip ring 192 is an electromechanical device that allows the transmission of power and electrical signals from a rotating device, such as drive roller assembly 126 to a stationary device such as main controller 38 without the use of wires. The first conductive ring 190 may also be coupled to the main controller 38 by a rotary electrical joint, collector, electric swivel or a brush and commutator for example.

A second conductive ring 194 is mounted to the pinch roller assembly 124 and electrically coupled to the main controller 38, by a slip ring 196 for example. The second conductive ring 194 may be mounted to the pinch roller assembly 124 by any suitable means, including but not limited to a press fit or bonding for example. The first conductive ring 190 and the second conductive ring 194 are arranged on their respective rollers 126, 124 to be in contact when no sheet product 26 is positioned within the rollers 126, 124. When the first conductive ring 190 and second conductive ring 194 are in contact, a circuit is completed allowing electrical current to flow from the first conductive ring 190 to the second conductive ring 194. The flow of current indicates to the main controller 38 that the sheet product 26 on stub roll 70 has been depleted. When sheet product 26 is present, the sheet acts as an insulator breaking the circuit and preventing current flow. Since the main controller 38 is only sensing current flow, this embodiment may be implemented with very low electrical power requirements to avoid depletion of the sheet product dispenser batteries 46.

Once a signal is transferred to the main controller 38, the controller activates a transfer bar assembly 94 that moves the leading edge of the main sheet product roll 72 into the nip such that the sheet product 26 from the main sheet product roll 72 is pulled by the roller assembly 74. An exemplary transfer bar assembly 94 is shown in FIG. 13 and FIGS. 19-22. The transfer bar assembly 94 includes a transfer bar 198 that extends substantially across the width of the dispenser mechanism 40. The transfer bar 198 includes a pair of arms 202, 204 each of which includes a pivot 200 that couples the transfer bar 198 to the chassis 82. The transfer bar 198 is movable between a first position (FIG. 14) and a second position (FIG. 13) to engage the sheet product 26 with the roller assembly 74.

The transfer bar arm 202 includes a slot 206 that is sized to receive a tab portion 208 of a cam arm 210. In the exemplary embodiment, the tab portion 208 couples the cam arm 210 to the transfer bar 198 by a snap fit. The cam arm 210 is arranged within an opening 212 in the chassis 82. The opening 212 maintains the motion of the cam arm 210 linear as the cam arm 210 moves the transfer bar from the first position (FIG. 14) to a second position (FIG. 13). The cam arm 210 includes an opening 214 that is sized to receive an end loop of spring 216. The opposite end of the spring 216 couples to a pin 218 on the chassis 82. The spring 216 biases the cam arm 210 such that a contact surface 220 on the cam arm 210 maintains contact with a cam 222.

The cam 222 is coupled for rotation to the chassis 82. The cam 222 includes a projection 224 having a cam surface 226 thereon. The cam surface 226 has a profile that defines the movement of the cam arm opening 214. On a side opposite the projection 224, the cam 222 includes a gear portion 228. In the exemplary embodiment, the cam 222 also includes a first projection 230 and a second projection 232 arranged adjacent to, and radially outward from, the gear portion 228. In the exemplary embodiment, the projections 230, 232 are arranged 180 degrees apart. As will be discussed in more detail below, the projections 230, 232 cooperate with tabs 240, 242 on the chassis 82 to provide a positive stop for the motion of cam 222.

The gear portion 228 includes a plurality of teeth with a size and pitch suitable to engage a pinion gear 234. The pinion gear 234 is mounted to a shaft 236 of motor 238. The motor 238 is mounted to the inside of the chassis 82 by a suitable fastener, and the shaft 236 extends through an opening in the chassis 82.

During operation, when the main controller 38 determines that the sheet product 26 from stub roll 70 has been depleted, the main controller 38 activates motor 238. Motor 238 rotates pinion gear 234 and cam 222 via gear portion 228. Due to the profile of cam surface 226, the cam arm 210 slides linearly within the slot 206 from a first position where the transfer bar 198 is on an angle relative to the top of the chassis 82 (FIG. 14). As the motor 238 rotates, the cam arm 210 slides towards the cam 222 causing the transfer bar 198 to rotate about pivot 200 to a second position substantially planar with the top of the chassis 82 (FIG. 14). In this position, the projections 230, 232 of cam 222 engage the tabs 240, 242. Since the tabs 240, 242 are fixed, the motion of the gear portion 228 stops placing the motor 238 into a stall condition. The main controller 38 detects the stall condition, such as by an increase in current draw by the motor 238 for example. In one embodiment, upon detecting the stall condition, the main controller 38 reverses the direction of rotation of the motor 238. In another embodiment, upon detecting the stall condition, the main controller 238 deactivates the motor 238.

As discussed above, when in the second position, the transfer bar 198 causes the sheet product 26 from main-sheet product roll 72 to engage the roller assembly 74. The main controller 38 then activates the drive motor assembly 92 causing the drive roller assembly 126 to rotate. The sheet product 26 is drawn through the nip and into dispensing slot 32. Once a sufficient amount of sheet product 26 has been dispensed through dispensing slot 32, the drive motor assembly 92 is deactivated. It should be appreciated that once the sheet product 26 from the main sheet product roll 72 is engaged with the roller assembly 74, the sensor, such as optical emitter 166 and optical receiver 168 will detect the presence of the sheet product 26.

Figure 23:
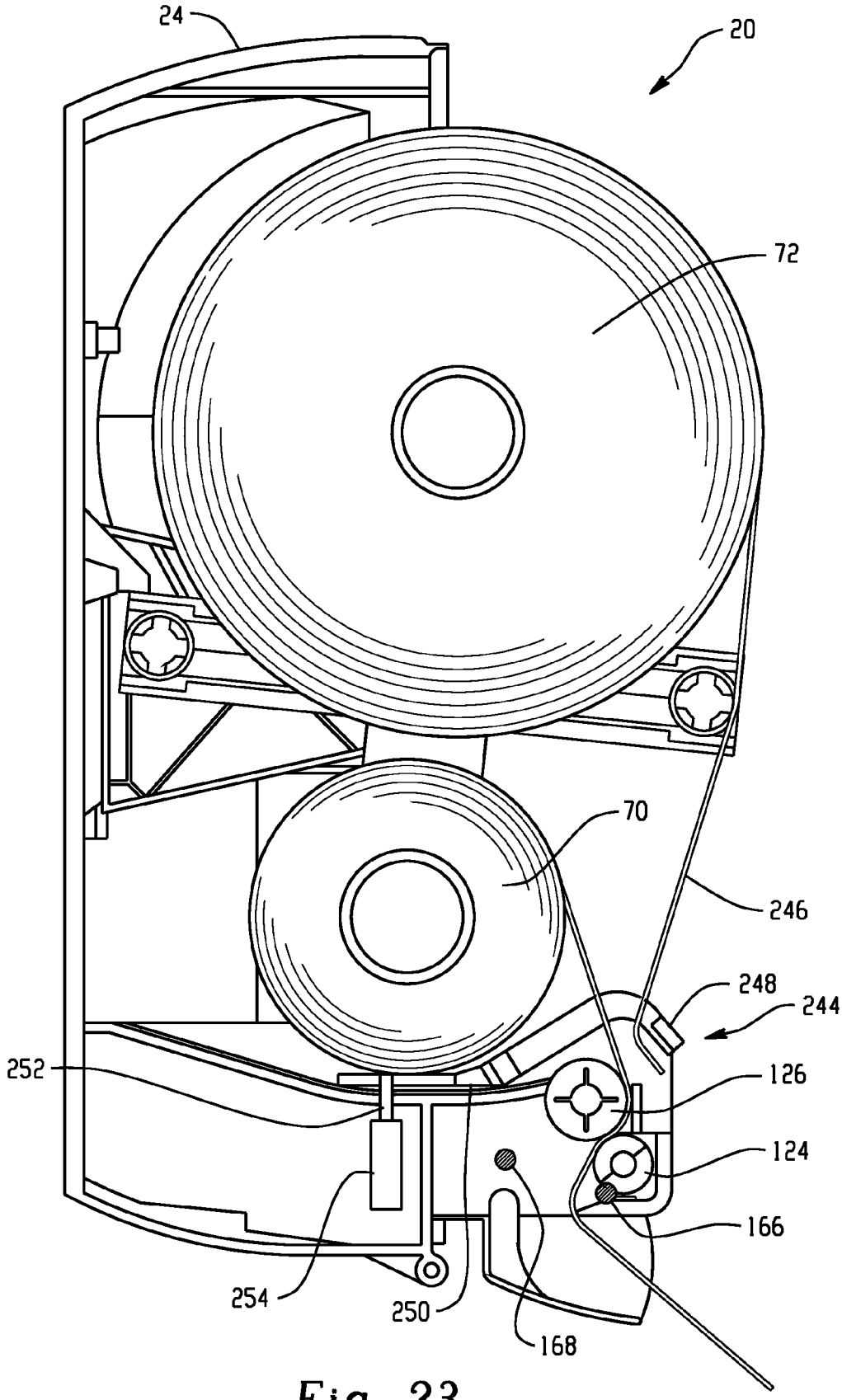
FIG. 23 is a side plan view partially in section of another embodiment transfer bar assembly for the dispensing mechanism of FIG. 5.
Figure 24:
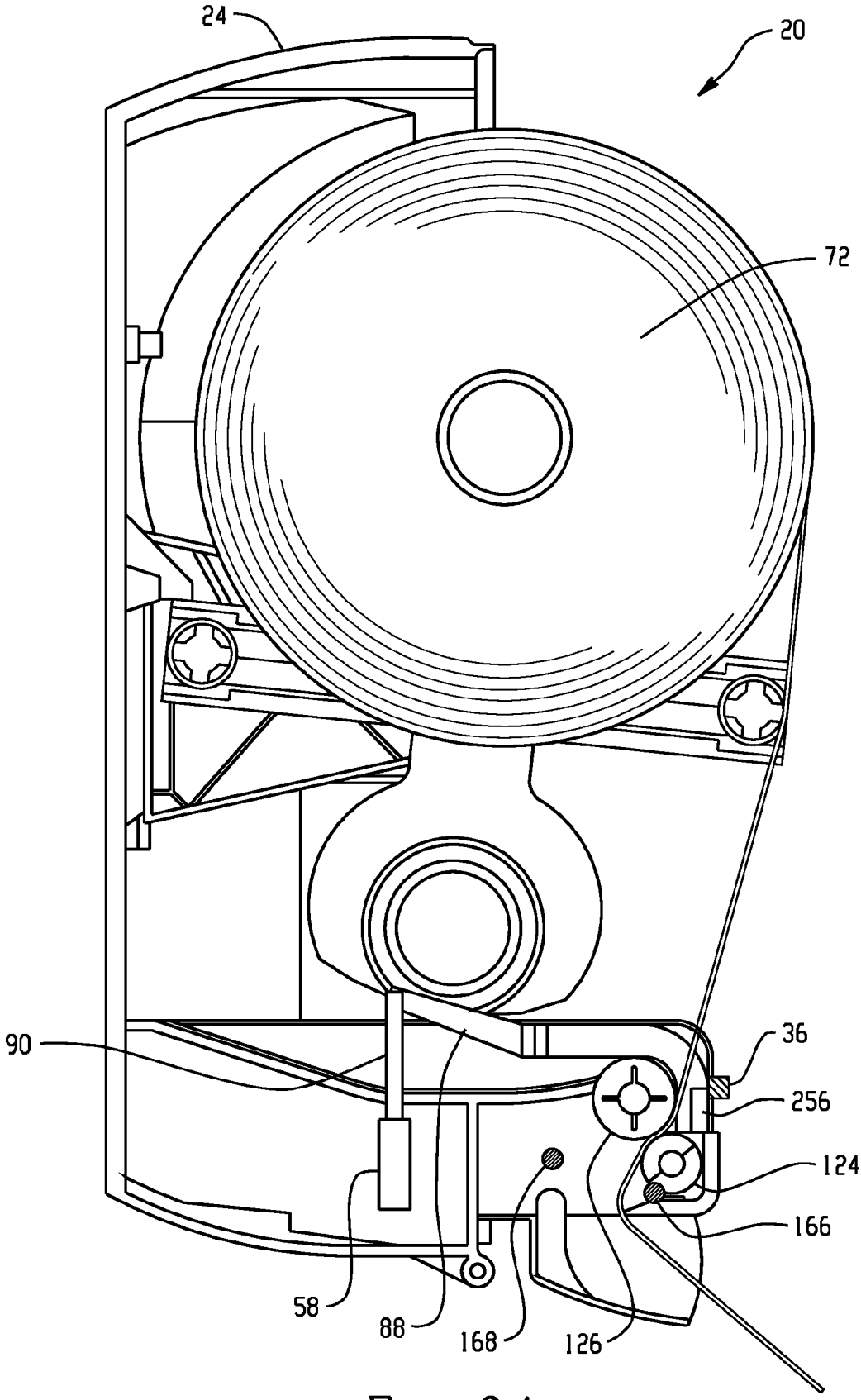
FIG. 24 is a side plan view partially in section of the transfer bar assembly of FIG. 23.
Figure 25:
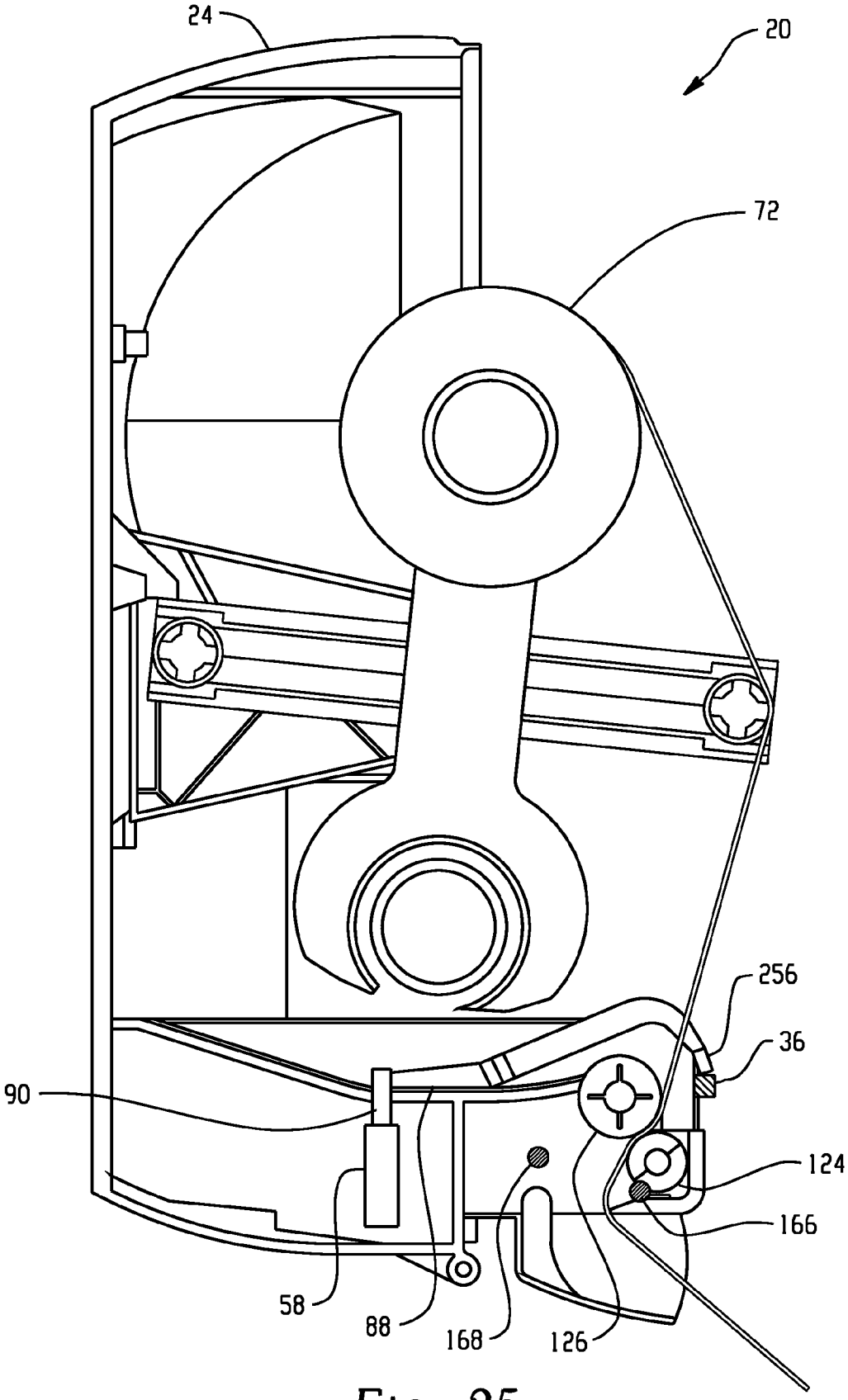
FIG. 25 is a side plan view partially in section of the transfer bar assembly of FIG. 23; and, FIG. 26 is a flow diagram illustration of a method of operating a sheet product dispenser.

Another embodiment transfer bar assembly 244 is shown in FIGS. 23-25. In this embodiment, the main sheet product roll 72 includes a leading edge portion 246 that is positioned adjacent a transfer bar 248. The transfer bar 248 includes a body portion 250 that is coupled to the movable plunger 252 on the electromechanical actuator 254. In this embodiment, the electromechanical actuator 254 is a solenoid. An arm portion 256 extends from the transfer bar body portion 250 adjacent the drive roller assembly 126. The arm 256 extends substantially parallel to the drive roller assembly 126 transversely across the front of the sheet product dispenser 20 to engage the main roll leading edge 246.

During the initial operation following maintenance of the sheet product dispenser 20, the roller assemblies 124, 126 pull the sheet product 26 from the stub roll 70 when the proximity sensor 36 is activated. When the sheet product 26 contained on the stub roll 70 is either depleted or near depletion, the sensor 166, 168 transmits a signal to the main controller 38. In response to the signal from sensor, the main controller 38 activates electromechanical actuator 254 causing the plunger 252 to move under the influence of the magnetic field generated by an actuator core (not shown). The movement of the plunger 252 causes the transfer bar 248 to pivot. The resulting pivoting motion of the transfer bar 248 causes the arm portion 256 to close or reduce the gap between the leading edge 246 of the sheet product 26 and the roller assemblies 124, 126.

As the gap is reduced, the leading edge 246 is placed in contact with the drive roller assembly 126. The resulting friction between the leading edge 246 and the drive roller assembly 126 draws the leading edge 246 into the nip between the roller assemblies 124, 126. Thus, the movement of the transfer bar 248 results in the sheet product 26 from main sheet product roll 72 being dispensed from the sheet product dispenser 20 in place of the stub roll 70.

In the exemplary embodiment, the sensor signal is transmitted by sensor 166, 168 once the sheet product 26 from stub roll 70 is depleted. This allows the maximum utilization of sheet product 26 to minimize costs. However, in some embodiments, it may also be desirable to allow some overlap between the dispensing of sheet product 26 from the stub roll 70 and the main sheet product roll 72 to prevent the user from receiving a shortened sheet product 26. Therefore, the sensors 166, 168 may transmit a signal and cause main controller 38 to enter the transfer cycle 80 (FIG. 4) prior to full depletion of the stub roll 70. This alternate embodiment may be accomplished by placing the sensor 166, 168 farther from the roller assemblies 124, 126, by placing some type of indicator on the sheet product 26 near the end of the roll.

Once the leading edge 246 is engaged in the roller assemblies 124, 126, the actuator 254 is de-energized causing the plunger 252 to retract, under the force of a spring (not shown) for example. The retracting of the plunger 252 pivots the transfer bar 248 back to its original position. This allows the transfer bar 248 to be in position for maintenance personnel when the sheet product dispenser 20 is re-filled.

Figure 5:
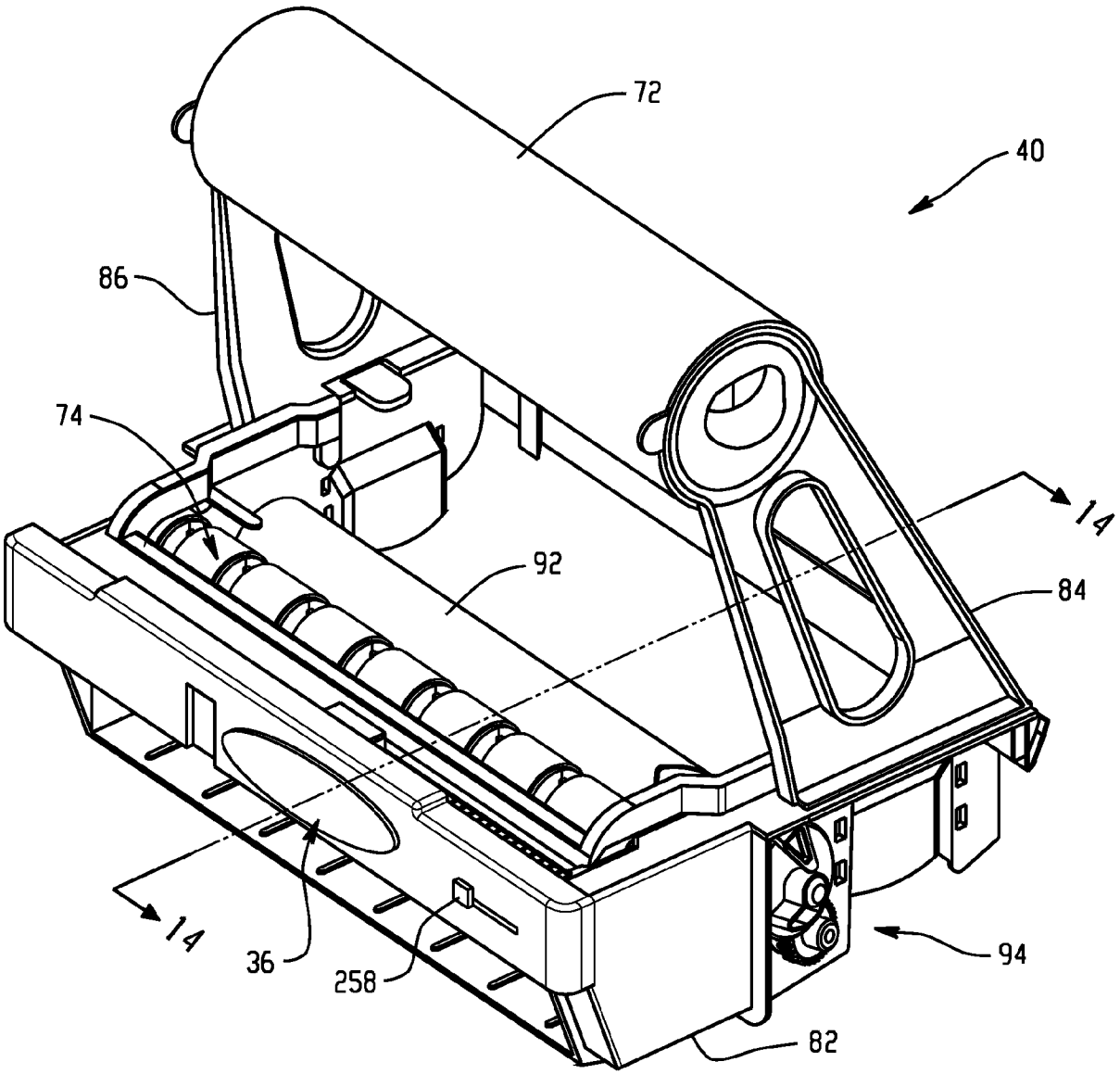
FIG. 5 is a perspective view illustration of an embodiment of a dispensing mechanism for the sheet product dispenser of FIG. 1.
Figure 6:
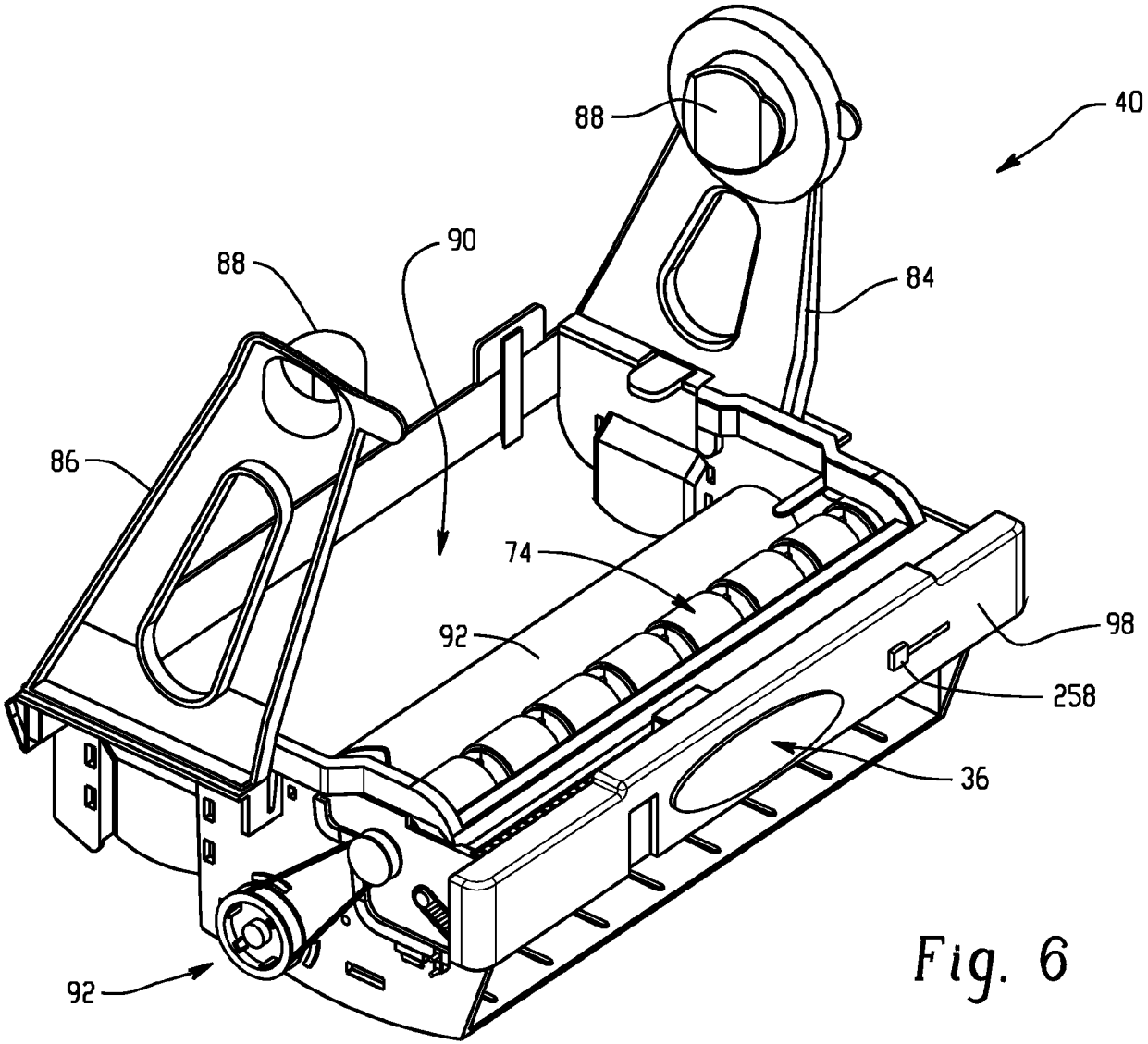
FIG. 6 is a reverse perspective view illustration of the dispensing mechanism of FIG. 4.
Figure 7:
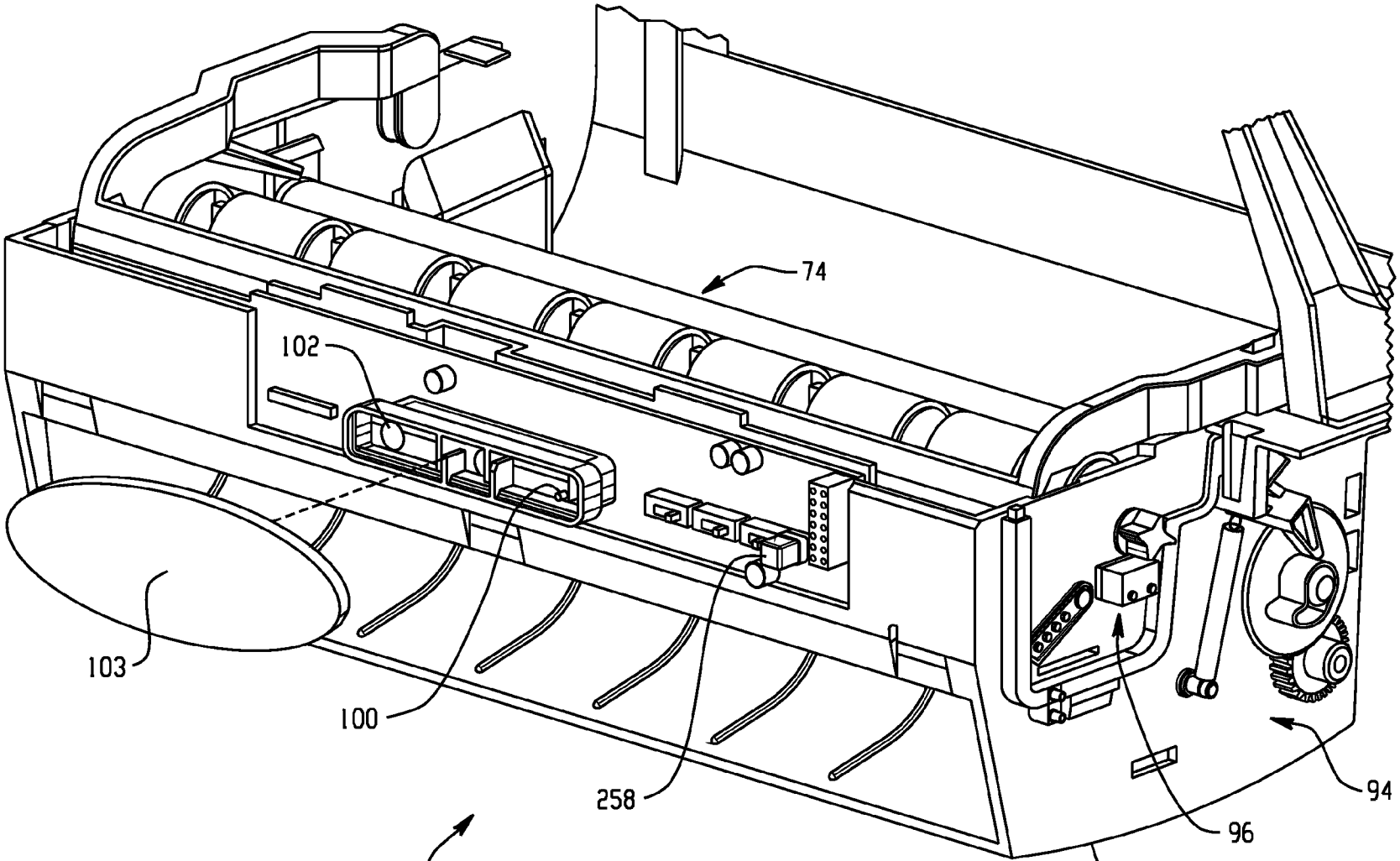
FIG. 7 is a partial view illustration of the dispensing mechanism of FIG. 4 with the sensing lens removed.
Figure 8:
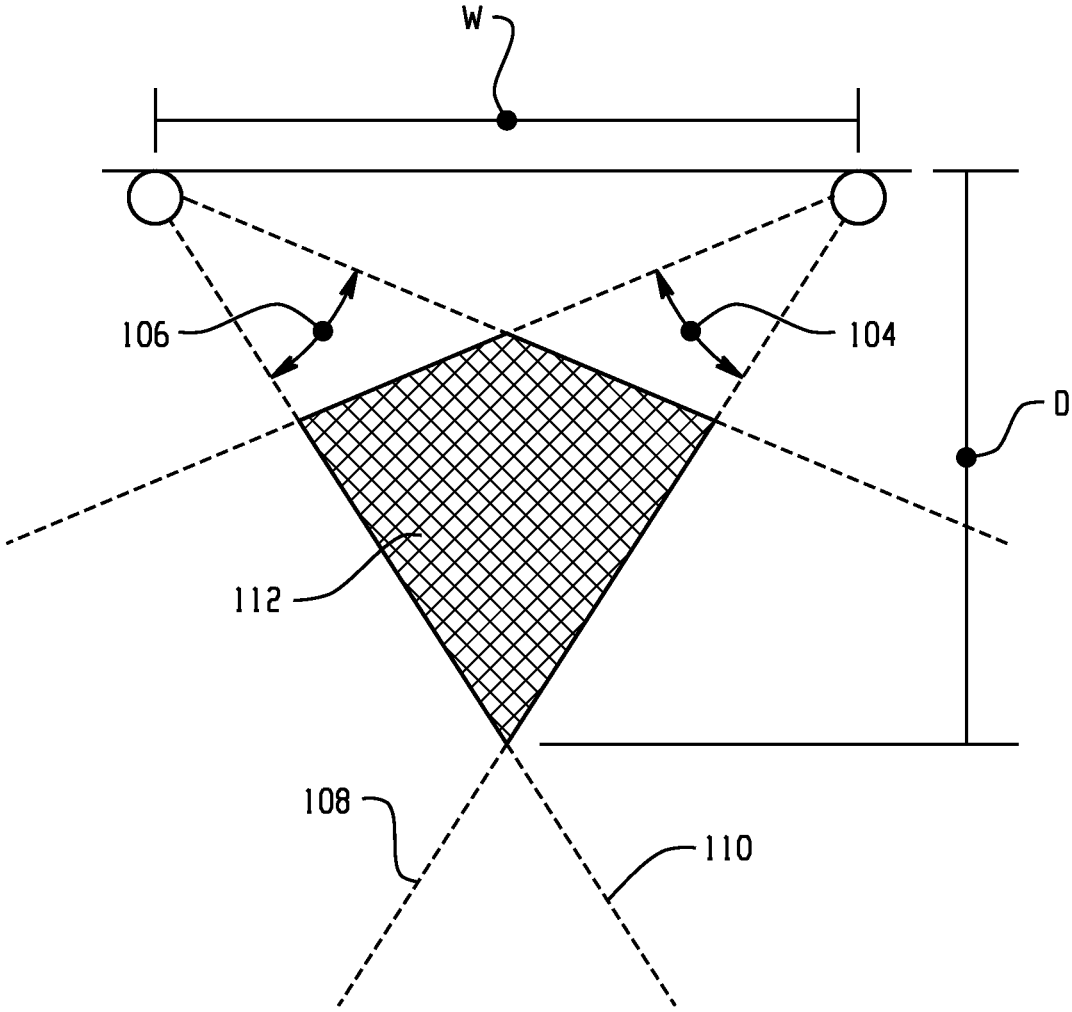
FIG. 8 is a schematic illustration of the field of view for the proximity sensor showing an area of high probability for triggering the proximity sensor.

During the re-filling process, the maintenance personnel need to remember to place the leading edge 246 of either the stub roll 70 or the main sheet product roll 72 into the roller assembly 74 so that the sheet product 26 may be properly dispensed. The maintenance personnel may either manually engage the sheet product 26 with the roller assembly 74 by turning the roller assembly by hand, or may use the drive motor assembly 92. The drive motor assembly 92 may be activated by the actuation of a switch or feed button 258 (FIGS. 5-7). Occasionally, maintenance personnel will re-fill the sheet product dispenser 20 and forget to load the sheet product 26 in the roller assembly 74. As a result, the sheet product dispenser 20 is full, but the sheet product 26 is not available for use.

Figure 26:
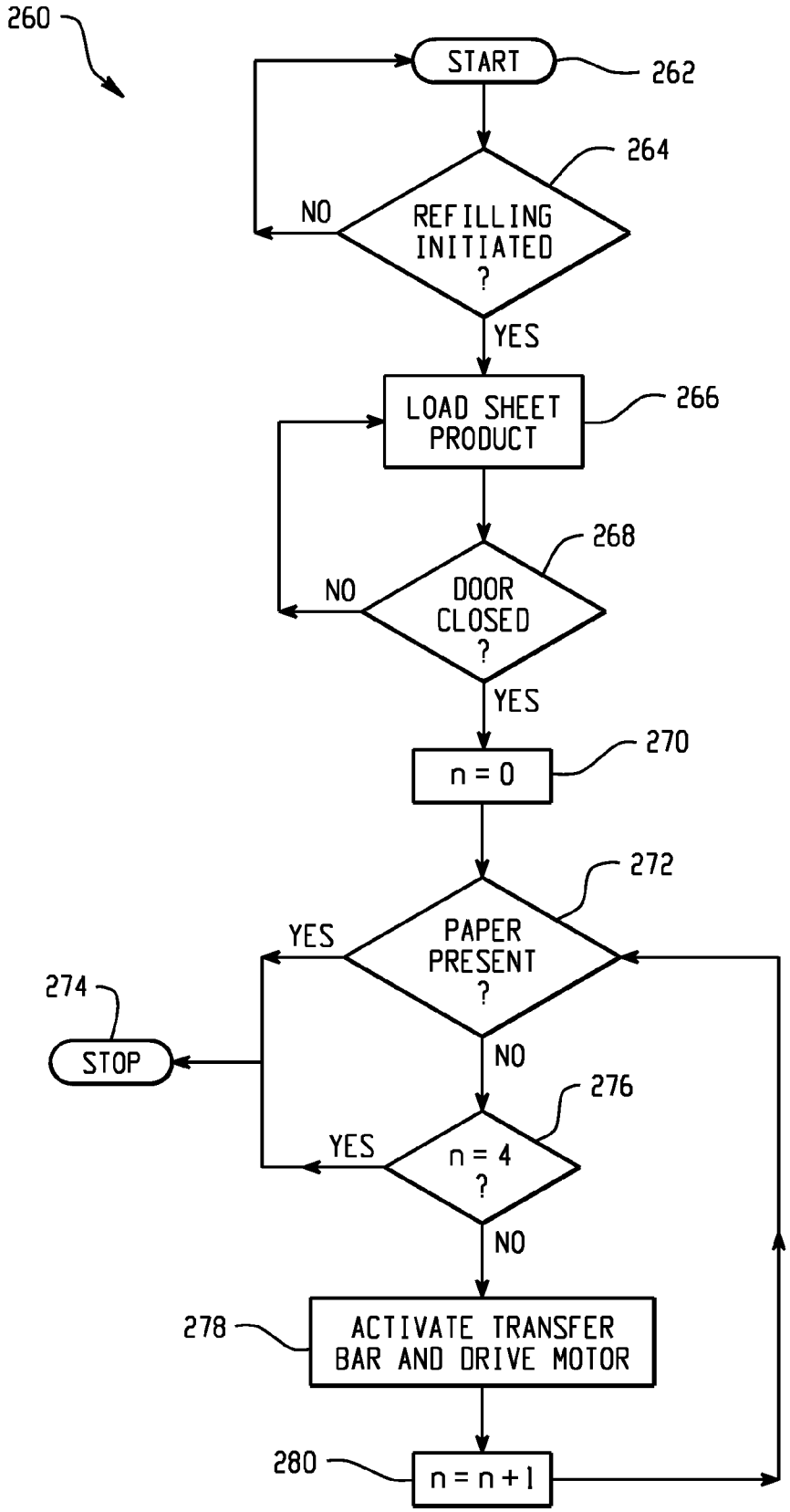

A method 260 of operating the sheet product dispenser 20 to automatically load sheet product 26 is shown in FIG. 26. The method 260 starts in block 262 and proceeds to query block 264 where it is determined whether re-filling operations have been initiated. If query block 264 returns a negative, the method 260 loops back to start block 262. If query block 264 returns a positive, the method 260 proceeds to block 266 where sheet product 26 is loaded into the sheet product dispenser 20 such as by maintenance personnel for example. The method 260 then proceeds to query block 268 where it is determined if the front cover 22 has been closed or replaced. If query block 268 returns a negative, indicating that the re-filling of sheet product 26 is continuing, the method 260 loops back to block 266. If query block 268 returns a positive, the method 260 proceeds to block 270.

In block 270, a counter variable "n" is set to zero. The method 260 then proceeds to query block 272 where is determined, such as by sensor 166, 168 for example, whether there is sheet product 26 in the dispensing slot 32 that is ready for dispensing. If the query block 272 returns a positive, indicating that the maintenance personnel properly loaded the sheet product 26, then the method 260 proceeds to block 274 where the method 260 terminates.

If query block 272 returns a negative, this indicates that sheet product 26 is not being detected by sensor 166, 168. The method 260 then proceeds to query block 276 where it is determined whether the counter variable "n" is equal to a predetermined number, such as four for example. The variable "n" determines the number of times that the sheet product dispenser 20 has activated the transfer bar assembly 94 in an attempt to load the sheet product 26. To avoid draining the battery, in one embodiment a maximum number of attempts, as defined by the variable "n" for example, is allowed before the sheet product dispenser 20 deactivates. If query block 276 determines that the variable "n" equals the maximum desired number of attempts (e.g. four), then the method 260 proceeds to block 274 and terminates.

If query block 276 returns a negative, then method 260 proceeds to block 278 where the transfer bar assembly 94 and the drive motor assembly 92 are activated in turn in an attempt to load the sheet product 26 into the roller assembly 74. Method 260 then proceeds to block 280 where the counter variable "n" is incremented and the method 260 loops back to query block 272 where it is determined if sheet product 26 is detected by sensor 166, 168. The method 260 continues to attempt to load the sheet product 26 until either the sensor 166, 168 detects the sheet product 26, or the maximum number of attempts has been reached.

Some embodiments provided herein describe the activation or initiation of operations of a dispenser with reference to an optical sensor arranged to sense the presence of the end-user, however the claimed invention should not be so limited. It should be appreciated that this is for exemplary purposes and that operation of a dispenser may be activated or initiated by the user pulling on the sheet product 26. This mode of operation, sometimes referred to as "hang mode" includes a sensor (not shown) associated with a tear bar, such as those described in Applicants co-pending United States patent application entitled "SHEET PRODUCT DISPENSER WITH SENSOR FOR SHEET SEPARATION" which is incorporated herein by reference in its entirety.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, front, rear, top, bottom etc. do not denote any orientation, order or importance, but rather the terms first, second, etc. are used to distinguish one element from another. Furthermore, the use of the terms a, an, etc. do not denote a limitation of quantity, but rather denote the presence of at least one of the referenced item.

What is claimed is:

1. A sheet product dispenser comprising:

a transfer bar movable between a first position and a second position;

a roller assembly positioned adjacent said transfer bar second position, said roller assembly having a feed roller and a pinch roller;

an electromechanical actuator having a movable portion coupled to said transfer bar, wherein said movable portion is arranged to move said transfer bar between said first position and said second position; and, a sensor in operable communication with said roller assembly, said sensor being electrically coupled to said electromechanical actuator wherein said movable portion moves said transfer bar from said first position to said second position in response to a signal from said sensor, said sensor comprising an optical detector having a light emitting diode configured to direct light at said feed roller, and a receiver.

2. The sheet product dispenser of claim 1 wherein said feed roller includes a surface that reduces reflection of light from said diode.

3. The sheet product dispenser of claim 1 further comprising:

a controller electrically coupled between said sensor and said electromechanical actuator, said controller being responsive to executable instructions to actuate said electromechanical actuator in response to a signal from said sensor.

4. The sheet product dispenser of claim 3 further comprising:

a motor operably coupled to said controller;

wherein said controller is further responsive to executable instructions to operate said motor for a predetermined amount of time in response to said electromechanical actuator being actuated.

5. A sheet product dispenser comprising:

a transfer bar movable between a first position and a second position;

a roller assembly positioned adjacent said transfer bar second position, said roller assembly having a feed roller and a pinch roller;

an electromechanical actuator having a movable portion coupled to said transfer bar, wherein said movable portion is arranged to move said transfer bar between said first position and said second position; and, a sensor in operable communication with said roller assembly, said sensor being electrically coupled to said electromechanical actuator wherein said movable portion moves said transfer bar from said first position to said second position in response to a signal from said sensor, wherein said sensor is a microswitch having an indicator movable between a first position and second position, wherein said second position is in contact with said feed roller.

6. The sheet product dispenser of claim 5 further comprising:

a controller electrically coupled between said sensor and said electromechanical actuator, said controller being responsive to executable instructions to actuate said electromechanical actuator in response to a signal from said sensor.

7. The sheet product dispenser of claim 6 further comprising:

a motor operably coupled to said controller;

wherein said controller is further responsive to executable instructions to operate said motor for a predetermined amount of time in response to said electromechanical actuator being actuated.

8. A sheet product dispenser comprising:

a transfer bar movable between a first position and a second position;

a roller assembly positioned adjacent said transfer bar second position, said roller assembly having a feed roller and a pinch roller;

an electromechanical actuator having a movable portion coupled to said transfer bar, wherein said movable portion is arranged to move said transfer bar between said first position and said second position; and, a sensor in operable communication with said roller assembly, said sensor being electrically coupled to said electromechanical actuator wherein said movable portion moves said transfer bar from said first position to said second position in response to a signal from said sensor, said sensor comprising:

a first conductive ring, coupled to said feed roller;

a second conductive ring, coupled to said pinch roller; and, wherein said first conductive ring and said second conductive ring are arranged to form an electrical circuit when there is no sheet product available for dispensing.

9. The sheet product dispenser of claim 8 further comprising:

a controller electrically coupled between said sensor and said electromechanical actuator, said controller being responsive to executable instructions to actuate said electromechanical actuator in response to a signal from said sensor.

10. The sheet product dispenser of claim 9 further comprising:

a motor operably coupled to said controller;

wherein said controller is further responsive to executable instructions to operate said motor for a predetermined amount of time in response to said electromechanical actuator being actuated.

* * * * *